US011094297B2

(12) United States Patent
Winzer et al.

(10) Patent No.: US 11,094,297 B2
(45) Date of Patent: Aug. 17, 2021

(54) ELECTRICALLY ENABLED SOUND POST FOR STRINGED MUSICAL INSTRUMENTS

(71) Applicants: Peter Winzer, Aberdeen, NJ (US); Matthias Lehner, New York, NY (US)

(72) Inventors: Peter Winzer, Aberdeen, NJ (US); Matthias Lehner, New York, NY (US)

( * ) Notice: Subject to any disclaimer, the term of this patent is extended or adjusted under 35 U.S.C. 154(b) by 0 days.

(21) Appl. No.: 16/996,440

(22) Filed: Aug. 18, 2020

(65) Prior Publication Data

US 2021/0065661 A1 Mar. 4, 2021

Related U.S. Application Data

(63) Continuation-in-part of application No. 16/559,265, filed on Sep. 3, 2019, now abandoned.

(51) Int. Cl.

| | |
|---|---|
| ***G10D 3/02*** | (2006.01) |
| ***G10D 1/02*** | (2006.01) |
| ***G10H 3/14*** | (2006.01) |
| ***G10H 3/18*** | (2006.01) |

(52) U.S. Cl.

CPC ..... *G10D 3/02* (2013.01); *G10D 1/02* (2013.01); *G10H 3/143* (2013.01); *G10H 3/185* (2013.01); *G10H 2220/525* (2013.01)

(58) Field of Classification Search

CPC ..... G10D 3/02; G10D 1/02; G10H 3/143; G10H 3/185; G10H 2220/525

USPC ..... 84/731

See application file for complete search history.

(56) References Cited

U.S. PATENT DOCUMENTS

| | | | | |
|---|---|---|---|---|
| 1,897,531 A * | 2/1933 | Pasko | ..... | G10D 3/02 84/277 |
| 2,145,237 A * | 1/1939 | Eberhart | ..... | G10D 3/02 84/277 |
| 2,154,025 A * | 4/1939 | Born | ..... | G10D 3/02 84/277 |
| 2,162,595 A * | 6/1939 | Virzi | ..... | G10D 3/02 84/277 |

(Continued)

FOREIGN PATENT DOCUMENTS

| | | | | |
|---|---|---|---|---|
| CH | 671110 A5 * | 7/1989 | ..... | G10H 3/146 |
| GB | 383119 A * | 11/1932 | ..... | G10D 3/02 |

OTHER PUBLICATIONS

Boutin and Besnainou, Physical parameters of the violin bridge changed by active control, Acoustics'08, Jun. 29-Jul. 4, 2008, Paris, France, Provided in parent application.

(Continued)

*Primary Examiner* — Christina M Schreiber

(57) ABSTRACT

A sound post assembly for a musical instrument, comprising two or more mechanically movable parts that allow for a length adjustment of the sound post assembly and one or more electrical components. In an example embodiment, the electrical components are configured to electrically measure the force exerted by the sound post on the upper and lower walls of the instrument's sound box. In some embodiments, the electrical components may operate to mechanically change the length of the sound post assembly through an electrical actuator, such as a piezo-electric actuator or an electro-magnetic motor. Also disclosed are example safety mechanisms and methods of wiring and interfacing said sound post assembly with a control unit.

21 Claims, 9 Drawing Sheets

(56) References Cited

U.S. PATENT DOCUMENTS

| | | | | | |
|---|---|---|---|---|---|
| 2,236,701 | A * | 4/1941 | Virzi | G10D 3/04 | 84/277 |
| 2,487,349 | A | 11/1949 | Marholz | | |
| 3,733,425 | A * | 5/1973 | Chaki | G10H 3/146 | 84/731 |
| 4,357,500 | A | 11/1982 | Nilsen | | |
| 4,843,937 | A * | 7/1989 | Murphy | G10D 3/00 | 84/723 |
| 5,208,408 | A * | 5/1993 | Cave | G10D 3/02 | 84/277 |
| 5,641,932 | A * | 6/1997 | Lace | G10H 3/181 | 84/727 |
| 6,018,120 | A * | 1/2000 | Steinberger | G10D 1/02 | 84/276 |
| 9,940,911 | B2 * | 4/2018 | Molnar | G10D 3/02 | |
| 9,958,314 | B2 * | 5/2018 | Oba | G01H 3/00 | |
| 10,083,677 | B2 * | 9/2018 | Hamberger | G10D 3/02 | |
| 10,475,421 | B1 * | 11/2019 | Chung | G10D 3/14 | |
| 2008/0190263 | A1 * | 8/2008 | Drew | G10D 3/02 | 84/291 |
| 2009/0308232 | A1 * | 12/2009 | McMillen | G10D 3/16 | 84/723 |
| 2012/0090449 | A1 * | 4/2012 | Lee | G10H 3/181 | 84/731 |
| 2013/0139669 | A1 * | 6/2013 | Siwko | G10D 3/00 | 84/277 |
| 2014/0090488 | A1 * | 4/2014 | Taylor | G01L 9/12 | 73/862.625 |
| 2016/0314767 | A1 * | 10/2016 | Lee | G10D 3/00 | |
| 2017/0249927 | A1 * | 8/2017 | Hamberger | G10D 3/14 | |
| 2018/0040310 | A1 * | 2/2018 | Molnar | G10D 3/02 | |
| 2020/0118528 | A1 * | 4/2020 | Upton | G10G 5/005 | |

OTHER PUBLICATIONS

International Search Report and Written Opinion of the International Searching Authority, PCT/US2020/047776, dated Nov. 9, 2020.

* cited by examiner

910

920

ELECTRICALLY ENABLED SOUND POST FOR STRINGED MUSICAL INSTRUMENTS

CROSS-REFERENCE TO RELATED APPLICATIONS

This application is a continuation-in-part of U.S. patent application Ser. No. 16/559,265, filed on Sep. 3, 2019, and entitled "ELECTRICALLY ENABLED SOUND POST FOR STRINGED MUSICAL INSTRUMENTS," which is incorporated herein by reference in its entirety.

BACKGROUND

Field

Various example embodiments generally relate to sound posts for musical instruments and, more specifically but not exclusively, to sound posts for stringed musical instruments.

Description of the Related Art

This section introduces aspects that may help facilitate a better understanding of the disclosure. Accordingly, the statements of this section are to be read in this light and are not to be understood as admissions about what is in the prior art or what is not in the prior art.

Many types of stringed musical instruments, such as the violin, the viola, the violoncello, the double bass, and others use a "bridge" that connects the strings to an upper wall of the instrument's sound box. The bridge transfers acoustic vibrations from the strings to the upper wall of the sound box. Further, such instruments may use a "sound post" within the instrument's sound box to connect an upper wall of the instrument's sound box with a lower wall of the instrument's sound box. The sound post transfers acoustic vibrations from the upper wall to the lower wall.

Length and position of the sound post are of material importance to the sound quality of an instrument, as both parameters impact the mechanical pressure that the upper wall of the instrument exerts onto the lower wall, thus changing the instrument body's acoustic resonance properties. For centuries, luthiers have used cylindrical wooden sticks as sound posts and have adjusted their lengths, the angles at which they are cut, and their placement within the sound box, in an effort to fine-tune the tone quality of the instrument.

Changing humidity levels may necessitate frequent sound post adjustments. These are typically made in relatively lengthy adjustment sessions involving the musician and the luthier, based on subjective sound quality assessments with limited reproducibility.

Since the 1930s, certain mechanically adjustable sound post assemblies have been disclosed, comprising manually adjustable components that allow to vary the total length of the sound post assembly by adding or removing mechanical spacers or by manually adjusting lead screws using relatively complicated wrench tools. In addition to their length adjustability, ball-and-socket-based swivel arrangements at one or both ends of the sound post assemblies have been introduced to adapt the sound post ends to the local curvature of the sound box's upper and lower walls [see, e.g., U.S. Pat. Nos. 2,145,237; 2,162,595; 5,208,408; 9,940,911; and U.S. Patent Application Publication No. 2017/0249927, all of which are incorporated herein by reference in their entirety]. Some of these sound post assemblies may allow for fine-tuning of the sound post's position and length, but still involve rather intricate manual adjustments by the luthier based on subjective sound quality assessments by the luthier and musician.

SUMMARY OF THE INVENTION

Disclosed herein are various embodiments of electrically enabled sound post assemblies, and in particular of electrically enabled sound post assemblies used in stringed musical instruments, aiming both at:

(i) static and/or quasi-static electrical sensor functions (e.g., electrically measuring and monitoring certain parameters, such as the static or quasi-static mechanical pressure (or the static or quasi-static mechanical force) exerted by the sound post on upper and lower walls of the instrument's sound box, the humidity level, and/or the temperature), and (ii) electrical actuator functions (e.g., adjusting the static or quasi-static mechanical pressure (or the static or quasi-static mechanical force) exerted by the sound post on the upper and lower walls of the instrument's sound box through piezo-electric or electro-magnetic motor arrangements).

In some embodiments disclosed herein, sensing and actuation functions can be performed:

(i) in open-loop operation, e.g., by reading or measuring the static or quasi-static mechanical pressure (or the static or quasi-static mechanical force) exerted by the sound post on the upper and lower walls of the instrument's sound box from a static or quasi-static electrical pressure and/or force sensor, and adjusting the static or quasi-static mechanical pressure (or the static or quasi-static mechanical force) exerted by the sound post on the upper and lower walls of the instrument's sound box through an electrical actuator of the sound post assembly, e.g., via a user-operated control unit, a computer-controlled program, or a smart phone application, and/or (ii) in closed-loop operation, e.g., by letting the sound post assembly automatically adjust the static or quasi-static mechanical pressure (or the static or quasi-static mechanical force) exerted by the sound post on the upper and lower walls of the instrument's sound box via an electrical actuator of the sound post assembly, based on readings from a static or quasi-static electrical pressure and/or force sensor of the sound post assembly, either continuously or in regular or irregular time intervals.

According to one example embodiment, provided is a stringed musical instrument comprising a sound box having an inner cavity bounded by an upper wall and a lower wall thereof; a sound-post assembly having ends thereof connecting, directly or indirectly, the upper and lower walls in the inner cavity, the sound post assembly including two or more mechanical components movable with respect to one another to change an end-to-end length of the sound-post assembly; and wherein the sound-post assembly comprises a static or quasi-static force sensor.

In some embodiments of the above stringed instrument, the static or quasi-static force sensor comprises a piezoresistive material.

In some embodiments of any of the above stringed instruments, the piezoresistive material is sandwiched between first and second electrodes electrically connectable to an electrical circuit.

In some embodiments of any of the above stringed instruments, the static or quasi-static force sensor is a static force sensor.

In some embodiments of any of the above stringed instruments, the static or quasi-static force sensor is a quasi-static force sensor.

In some embodiments of any of the above stringed instruments, the static or quasi-static force sensor is configured to function as a static or quasi-static pressure sensor.

In some embodiments of any of the above stringed instruments, the static or quasi-static force sensor is electrically connectable to an external electrical circuit.

In some embodiments of any of the above stringed instruments, the static or quasi-static force sensor is configured to change one or more of: an electrical resistance thereof; an electrical capacitance thereof; an electrical inductance thereof, in response to a mechanical force applied thereto.

In some embodiments of any of the above stringed instruments, the static or quasi-static force sensor is sensitive to a varying force characterized by a frequency smaller than 15 Hz.

In some embodiments of any of the above stringed instruments, the static or quasi-static force sensor is sensitive to a varying force characterized by a frequency smaller than 1 Hz.

In some embodiments of any of the above stringed instruments, the sound-post assembly further comprises an electrical actuator connectable to an electrical circuit and configured to change the end-to-end length of the sound post assembly.

In some embodiments of any of the above stringed instruments, the electrical actuator comprises a piezoelectric material.

In some embodiments of any of the above stringed instruments, the electrical actuator comprises an electromagnetic motor connected to a lead screw arrangement.

In some embodiments of any of the above stringed instruments, the two or more mechanical components are mechanically engaged using a key-and-slot arrangement or a pin-and-hole arrangement to restrict relative rotational motion thereof.

In some embodiments of any of the above stringed instruments, the sound-post assembly further comprises a mechanism to break a flow of electrical power to the electrical actuator in response to the sound-post assembly reaching or exceeding a pre-determined length.

In some embodiments of any of the above stringed instruments, the pre-determined length is adjustable.

In some embodiments of any of the above stringed instruments, the mechanism comprises a contact rod mounted on a first of the two or more mechanical components and a sleeve mounted on a second of the two or more mechanical components.

In some embodiments of any of the above stringed instruments, the contact rod comprises elastic end faces.

In some embodiments of any of the above stringed instruments, the sleeve is longitudinally movable on the second mechanical component.

In some embodiments of any of the above stringed instruments, longitudinal movement is accomplished by a thread connecting the sleeve with the second mechanical component.

In some embodiments of any of the above stringed instruments, the string instrument further comprises a wall-mounted electrical connector connected by electrical wires to the static or quasi-static force sensor.

In some embodiments of any of the above stringed instruments, the wall-mounted electrical connector comprises a static magnet.

In some embodiments of any of the above stringed instruments, the wall-mounted electrical connector comprises a static magnet placed on an outer surface of the sound box.

In some embodiments of any of the above stringed instruments, the electrical wires are loosely coiled around an elastic mechanical element.

In some embodiments of any of the above stringed instruments, the length of the elastic mechanical element is extendable by at least 10%.

In some embodiments of any of the above stringed instruments, the length of the elastic mechanical element is extendable by at least 25%.

In some embodiments of any of the above stringed instruments, the two or more mechanical components include a swivel end cap including a swivel mechanism formed by a ball-and-socket arrangement; and wherein a center of a spherically shaped cavity of the socket is located below a rim of the swivel end cap by at least 10% of a sphere's radius corresponding to the spherically shaped cavity.

According to another example embodiment, provided is a sound-post assembly for a stringed musical instrument, the sound-post assembly comprising: two or more mechanical components movable with respect to one another to change an end-to-end length of the sound-post assembly; and a static or quasi-static force sensor; and wherein ends of the sound-post assembly are configured to connect upper and lower walls of an inner cavity of a sound box of the stringed musical instrument.

In some embodiments of the above sound post assembly, the static or quasi-static force sensor comprises a piezoresistive material.

In some embodiments of any of the above sound post assembly, the piezoresistive material is sandwiched between first and second electrodes electrically connectable to an electrical circuit.

In some embodiments of any of the above sound post assembly, the static or quasi-static force sensor is a static force sensor.

In some embodiments of any of the above sound post assembly, the static or quasi-static force sensor is a quasi-static force sensor.

In some embodiments of any of the above sound post assembly, the static or quasi-static force sensor is configured to function as a static or quasi-static pressure sensor.

In some embodiments of any of the above sound post assembly, the static or quasi-static force sensor is electrically connectable to an external electrical circuit.

In some embodiments of any of the above sound post assembly, the static or quasi-static force sensor is configured to change one or more of: an electrical resistance thereof; an electrical capacitance thereof; an electrical inductance thereof, in response to a mechanical force applied thereto.

In some embodiments of any of the above sound post assembly, the static or quasi-static force sensor is sensitive to a varying force characterized by a frequency smaller than 15 Hz.

In some embodiments of any of the above sound post assembly, the static or quasi-static force sensor is sensitive to a varying force characterized by a frequency smaller than 1 Hz.

In some embodiments of any of the above sound post assembly, the sound post assembly further comprises an electrical actuator connectable to an electrical circuit and configured to change the end-to-end length of the sound post assembly.

In some embodiments of any of the above sound post assembly, the electrical actuator comprises a piezoelectric material.

In some embodiments of any of the above sound post assembly, the electrical actuator comprises an electro-magnetic motor connected to a lead screw arrangement.

In some embodiments of any of the above sound post assembly, the two or more mechanical components are mechanically engaged using a key-and-slot arrangement or a pin-and-hole arrangement to restrict relative rotational motion thereof.

In some embodiments of any of the above sound post assembly, the sound post assembly further comprises a mechanism to break a flow of electrical power to the electrical actuator in response to the sound-post assembly reaching or exceeding a pre-determined length.

In some embodiments of any of the above sound post assembly, the pre-determined length is adjustable.

In some embodiments of any of the above sound post assembly, the mechanism comprises a contact rod mounted on a first of the two or more mechanical components and a sleeve mounted on a second of the two or more mechanical components.

In some embodiments of any of the above sound post assembly, the contact rod comprises elastic end faces.

In some embodiments of any of the above sound post assembly, the sleeve is longitudinally movable on the second mechanical component.

In some embodiments of any of the above sound post assembly, longitudinal movement is accomplished by a thread connecting the sleeve with the second mechanical component.

In some embodiments of any of the above sound post assembly, the sound post assembly further comprises a wall-mounted electrical connector connected by electrical wires to the static or quasi-static force sensor.

In some embodiments of any of the above sound post assembly, the wall-mounted electrical connector comprises a static magnet.

In some embodiments of any of the above sound post assembly, the wall-mounted electrical connector comprises a static magnet placed on an outer surface of the sound box.

In some embodiments of any of the above sound post assembly, the electrical wires are loosely coiled around an elastic mechanical element.

In some embodiments of any of the above sound post assembly, the length of the elastic mechanical element is extendable by at least 10%.

In some embodiments of any of the above sound post assembly, the length of the elastic mechanical element is extendable by at least 25%.

In some embodiments of any of the above sound post assembly, the two or more mechanical components include a swivel end cap including a swivel mechanism formed by a ball-and-socket arrangement; and wherein a center of a spherically shaped cavity of the socket is located below a rim of the swivel end cap by at least 10% of a sphere's radius corresponding to the spherically shaped cavity.

According to yet another example embodiment, provided is an apparatus, comprising: a sound-post assembly for a stringed musical instrument; and a control unit to electrically interface to one or more functions of the sound-post assembly; wherein the sound-post assembly comprises: two or more mechanical components movable with respect to one another to change an end-to-end length of the sound-post assembly; and a static or quasi-static force sensor; wherein ends of the sound-post assembly are configured to connect, directly or indirectly, upper and lower walls of an inner cavity of a sound box of the stringed musical instrument; and wherein the static or quasi-static force sensor is electrically connectable to the control unit.

In some embodiments of the above apparatus, the control unit is configured to read sensor data from the static or quasi-static force sensor.

In some embodiments of any of the above apparatus, the control unit is configured to filter the sensor data using a low-pass cut-off frequency smaller than 15 Hz.

In some embodiments of any of the above apparatus, the control unit is configured to filter the sensor data using a low-pass cut-off frequency smaller than 1 Hz.

In some embodiments of any of the above apparatus, the apparatus further includes an electrical actuator configured to change the end-to-end length of the sound-post assembly; and wherein the control unit is configured to apply an electrical control signal to the electrical actuator in response to the sensor data.

In some embodiments of any of the above apparatus, the apparatus further includes an electrical actuator configured to change the end-to-end length of the sound-post assembly.

In some embodiments of any of the above apparatus, the control unit is configured to apply an electrical control signal to the electrical actuator.

In some embodiments of any of the above apparatus, the control unit is further configured to read sensor data from the static or quasi-static force sensor; and wherein the electrical control signal depends on said sensor data.

In some embodiments of any of the above apparatus, the control unit is configured to operate the static or quasi-static force sensor and the electrical actuator in a closed-loop setting to maintain a sensor reading within a fixed range.

In some embodiments of any of the above apparatus, the static or quasi-static force sensor comprises a piezoresistive material.

In some embodiments of any of the above apparatus, the piezoresistive material is sandwiched between first and second electrodes electrically connectable to an electrical circuit.

In some embodiments of any of the above apparatus, the static or quasi-static force sensor is a static force sensor.

In some embodiments of any of the above apparatus, the static or quasi-static force sensor is a quasi-static force sensor.

In some embodiments of any of the above apparatus, the static or quasi-static force sensor is configured to function as a static or quasi-static pressure sensor.

In some embodiments of any of the above apparatus, the static or quasi-static force sensor is electrically connectable to an external electrical circuit.

In some embodiments of any of the above apparatus, the static or quasi-static force sensor is configured to change one or more of: an electrical resistance thereof an electrical capacitance thereof; an electrical inductance thereof, in response to a mechanical force applied thereto.

In some embodiments of any of the above apparatus, the static or quasi-static force sensor is sensitive to a varying force characterized by a frequency smaller than 15 Hz.

In some embodiments of any of the above apparatus, the static or quasi-static force sensor is sensitive to a varying force characterized by a frequency smaller than 1 Hz.

In some embodiments of any of the above apparatus, the apparatus further comprises an electrical actuator connectable to an electrical circuit and configured to change the end-to-end length of the sound post assembly.

In some embodiments of any of the above apparatus, the electrical actuator comprises a piezoelectric material.

In some embodiments of any of the above apparatus, the electrical actuator comprises an electro-magnetic motor connected to a lead screw arrangement.

In some embodiments of any of the above apparatus, the two or more mechanical components are mechanically engaged using a key-and-slot arrangement or a pin-and-hole arrangement to restrict relative rotational motion thereof.

In some embodiments of any of the above apparatus, the apparatus further comprises a mechanism to break a flow of electrical power to the electrical actuator in response to the sound-post assembly reaching or exceeding a pre-determined length.

In some embodiments of any of the above apparatus, the pre-determined length is adjustable.

In some embodiments of any of the above apparatus, the mechanism comprises a contact rod mounted on a first of the two or more mechanical components and a sleeve mounted on a second of the two or more mechanical components.

In some embodiments of any of the above apparatus, the contact rod comprises elastic end faces.

In some embodiments of any of the above apparatus, the sleeve is longitudinally movable on the second mechanical component.

In some embodiments of any of the above apparatus, longitudinal movement is accomplished by a thread connecting the sleeve with the second mechanical component.

In some embodiments of any of the above apparatus, the apparatus further comprises a wall-mounted electrical connector connected by electrical wires to the static or quasi-static force sensor.

In some embodiments of any of the above apparatus, the wall-mounted electrical connector comprises a static magnet.

In some embodiments of any of the above apparatus, the wall-mounted electrical connector comprises a static magnet placed on an outer surface of the sound box.

In some embodiments of any of the above apparatus, the electrical wires are loosely coiled around an elastic mechanical element.

In some embodiments of any of the above apparatus, the length of the elastic mechanical element is extendable by at least 10%.

In some embodiments of any of the above apparatus, the length of the elastic mechanical element is extendable by at least 25%.

In some embodiments of any of the above apparatus, the two or more mechanical components include a swivel end cap including a swivel mechanism formed by a ball-and-socket arrangement; and wherein a center of a spherically shaped cavity of the socket is located below a rim of the swivel end cap by at least 10% of a sphere's radius corresponding to the spherically shaped cavity.

BRIEF DESCRIPTION OF THE DRAWINGS

Other aspects, features, and benefits of various disclosed embodiments will become more fully apparent, by way of example, from the following detailed description and the accompanying drawings, in which.

DETAILED DESCRIPTION OF SOME EMBODIMENTS

Figure 1A:
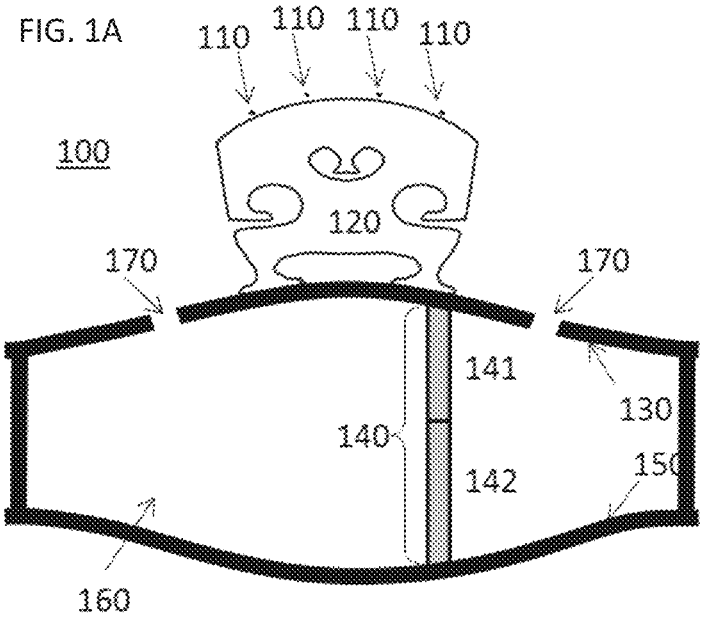
FIGS. 1A-1D show various schematic views and cross-sections of a string instrument comprising a sound post assembly.

Herein, a static or quasi-static electrical pressure sensor (or a static or quasi-static electrical force sensor) is a sensor element whose one or more electrical properties (e.g., a resistance, a capacitance, or an inductance) can change in response to a static or quasi-static mechanical pressure (or a static or quasi-static mechanical force) applied to the sensor. In operation, e.g., when assisted by a corresponding electrical read-out and/or control unit, a static or quasi-static electrical pressure sensor (or a static or quasi-static electrical force sensor) may produce one or more static or quasi-static electrical read-out signals (e.g., a current or a voltage).

Herein, a static or quasi-static electrical actuator is an actuator element configured to convert, in operation and assisted by a corresponding electrical control unit, one or more electrical signals into a slow length change of the sound post assembly.

Herein, a quantity is said to be "static" or "quasi-static" if the quantity changes only slowly compared to audible acoustic frequencies produced by the musical instrument that the sound post assembly is intended to be used within. For example, a double bass may typically produce acoustic frequencies as low as 30 Hz, and a quantity associated with the sound post assembly of a double bass may be considered static or quasi-static if at least 90% of the quantity's energy falls in a frequency range below 30 Hz. A violin may typically produce acoustic frequencies as low as 190 Hz, and a quantity associated with the sound post assembly of a violin may be considered static or quasi-static if at least 90% of the quantity's energy falls in a frequency range below 190 Hz. In more absolute terms, the audible acoustic frequencies of humans may be within the frequency range between approximately 15 Hz and 20 kHz, and a quantity may be called static or quasi-static if at least 90% of the quantity's energy falls in a frequency range below 10 Hz. In another example, a quantity may be called static or quasi-static if at least 90% of the quantity's energy falls in a frequency range below 1 Hz. Conversely, a quantity is said to be "dynamically varying" if the quantity has significant energy in the audible acoustic frequency range. In some embodiments, at least 90% of the energy of a dynamically varying quantity falls in a frequency range having frequencies higher than 15 Hz.

FIG. 1A shows a schematic cross-section 100 through the body of an example four-string instrument, whose four strings 110 rest on a bridge 120. Bridge 120 transfers the string vibrations onto the upper wall 130 of the instrument's sound box 160. A sound post 140, shown here as a sound post assembly comprising of two main components 141 and 142, transfers the string vibrations from the upper wall 130 to the lower wall 150 of the instrument's sound box 160. For example, the two sound post components 141 and 142 can be constructed such that the length of the overall sound post assembly 140 can be manually changed. This can be done, e.g., by inserting and removing mechanical spacers between the two sound post components; manually adjusting a male lead screw that is part of one sound post component relative to a female thread that is part of the other sound post component; manually adjusting a female threaded part relative to two lead screws that are each part of the two sound post components 141 and 142; or manually adjusting a lead screw relative to two female threaded parts that are each part of the two sound post components 141 and 142.

The ends of the two sound post components 141 and 142 facing the upper and lower walls of the instrument's sound box may be angle-cut as shown in FIG. 1A to match the local curvature of the sound box's upper wall 130 and lower wall 150.

Figure 1B:
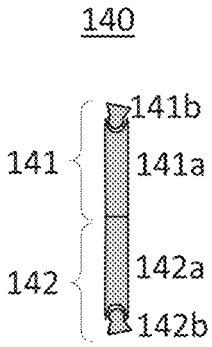

FIG. 1B shows an alternative embodiment to an angle-cut sound post assembly that comprises swivel arrangements at its end, e.g., with the ball being part of the movable swivel component 141*b* and swivel component 142*b*, and the socket being part of the fixed sound post components 141*a* and 142*a*.

The entire sound post assembly, either in full or in parts, is preferably dimensioned such as to be insertable through the instrument's f-holes 170.

Figure 1C:
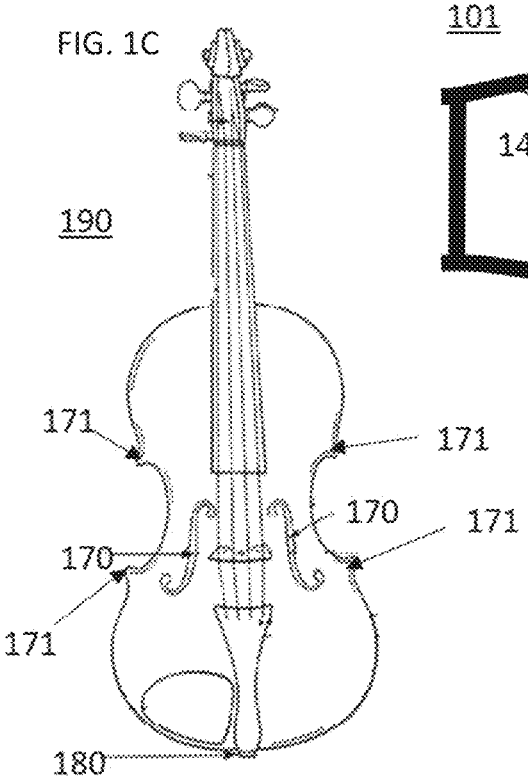

FIG. 1C shows the top view of an exemplary instrument 190. Insertion through the instrument's end pin 180 is also possible.

Figure 1D:
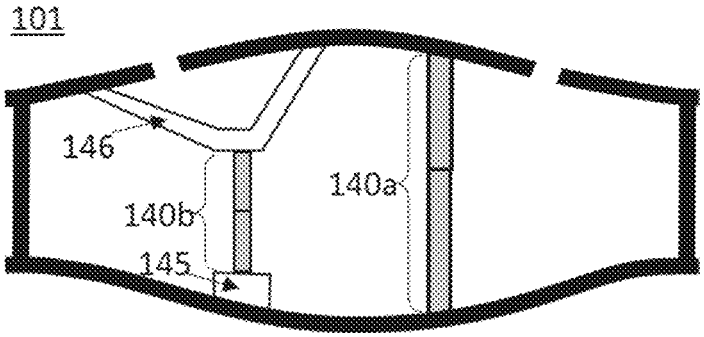

FIG. 1D shows a cross-sectional drawing 101 according to one embodiment. One or more sound post assemblies may be simultaneously used within an instrument. One or more sound post assemblies (e.g., 140*a* and 140*b*) may not directly connect the sound box's upper and lower walls, but may instead attach to further mechanical components such as spacer 145 or pressure distribution mechanism 146. The combination of the sound post assembly and such further mechanical components may eventually connect two or more interior parts of the sound box. Electrically enabled sound post assemblies as part of such further mechanical components and structures are included in this disclosure.

Efforts to rigorously quantify the mechanical properties of string instruments using electronics-aided techniques, such as static or quasi-static electrical pressure sensors (or static or quasi-static electrical force sensors), may be directed to the bridge. However, as the bridge may be highly visible to a musician's audience, modifications to the bridge may be much less attractive to a musician than solutions based on the sound post, which is hidden within the instrument.

FIGS. 2A-2F show different embodiments 240 of sound post assembly 140 according to the present disclosure. While none of these embodiments is shown with a swivel arrangement on either end, embodiments including swivel arrangements on one or both ends of the electrically-enabled sound post assembly are also included in this disclosure. In addition to the two mechanically adjustable sound post components 241 and 242, which may each comprise of one or more individual parts. The main functionally of sound post components 241 and 242 is to adjust the overall length of the sound post assembly, corresponding to components 141 and 142 of 140. In addition, the disclosed sound post assemblies also include one or more electrical components 245. The one or more electrical components may include one or more static or quasi-static sensors or one or more static or quasi-static actuators, and are characterized in that they are electrically connectable with electrical instrumentation units or to other electrical sound post components using electrically conductive elements 246, such as wires, metal foils, or solid metal parts. The electrical components 245 may be located at any position within various embodiments of sound post arrangements 240, some non-limiting examples of which are shown in FIG. 2.

Figure 2A:
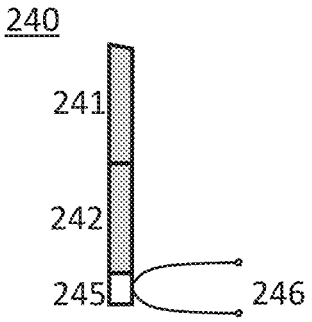
FIGS. 2A-2F show schematic views of sound post assemblies according to various embodiments.

FIG. 2A shows an embodiment with two sound post components 241 and 242 whose spacing is mechanically adjustable, e.g., by a lead screw as part of or attached to component 241 that is inserted into a female thread as part of or attached to component 242. Attached to component 242 is electrical component 245, e.g., a static or quasi-static electrical pressure sensor (or a static or quasi-static electrical force sensor) or a static or quasi-static electrical actuator such as a piezo-electric actuator or an electro-magnetic motor. An electro-magnetic motor may comprise a stator (e.g., the motor housing) and a rotor (e.g., the motor shaft). Electrical component 245 may electrically connect or be electrically connectable with further electrical circuitry, e.g., an electrical control unit, through electrical conductors 246.

Figure 2B:
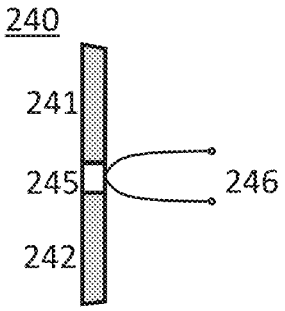

FIG. 2B shows an embodiment with two sound post components 241 and 242 and an electrical component 245 such as a piezo-electric actuator or an electro-magnetic motor, electrically connected or electrically connectable with further electric circuitry such as an electrical control unit through conductors 246. In one embodiment, piezo-electric actuator 245 is configured to lengthen or to shorten the spacing between components 241 and 242 via the piezo-electric effect. In one embodiment, electro-magnetic motor 245 is attached to component 242 such that a relative rotational motion between component 242 and the stator of electro-magnetic motor 245 is essentially prevented, e.g., by non-circularly-symmetric mechanical fittings, pins, screws, or glue. In one embodiment the rotor of electro-magnetic motor 245 is threaded to form a lead screw, which inserts into a female thread as part of or attached to component 241, thereby enabling component 241 to move up and down with respect to components 242 and 245 depending on the rotation direction of the rotor relative to the stator. In one embodiment the rotor of electro-magnetic motor 245 is attached to a lead screw, which inserts into a female thread as part of or attached to component 241, thereby enabling component 241 to move up and down with respect to components 242 and 245 depending on the rotation direction of the rotor relative to the stator.

Figure 2C:
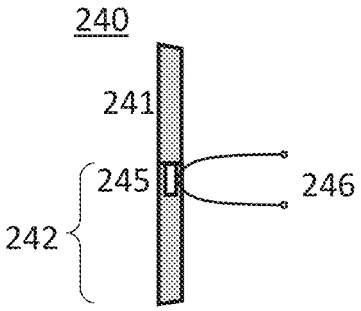

FIG. 2C shows an embodiment with two sound post components 241 and 242 and an electrical component 245 that is electrically connected or electrically connectable with further electric circuitry such as an electrical control unit through conductors 246 and that is embedded in sound post component 242. In an example embodiment, electrical component 245 may comprise a static or quasi-static electrical pressure sensor (or a static or quasi-static electrical force sensor). In an example embodiment, electrical component 245 may comprise an electrical actuator such as a piezo-electric actuator or an electro-magnetic motor. In one embodiment, component 245 can be a piezo-electric motor configured to lengthen or shorten the spacing between components 241 and 242 via the piezo-electric effect. In one embodiment, component 245 can be an electro-magnetic motor is attached to component 242 such that a relative rotational motion between components 242 and the stator of electro-magnetic motor 245 is essentially prevented, e.g., by non-circularly-symmetric mechanical fittings, pins, screws, or glue. In one embodiment, the rotor of electro-magnetic motor 245 is threaded to form a lead screw, which inserts into a female thread as part of or attached to component 241, thereby enabling component 241 to move up and down with respect to components 242 and 245 depending on the rotation direction of the rotor relative to the stator. In one embodiment, the rotor of electro-magnetic motor 245 is attached to a lead screw, which inserts into a female thread as part of or attached to component 241, thereby enabling component 241 to move up and down with respect to components 242 and 245 depending on the rotation direction of the rotor relative to the stator.

Figure 2D:
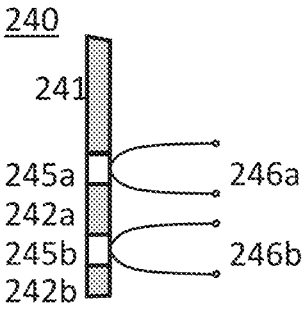

FIG. 2D shows an embodiment with two sound post components 241 and 242, whereby component 242 comprises two parts, 242*a* and 242*b*, and two electrical components 245*a* and 245*b*, such as one or more static or quasi-static electrical pressure sensors or one or more electrical actuators. In one embodiment, component 245*a* is an electrical actuator and component 245*b* is a static or quasi-static electrical pressure sensor (or static or quasi-static electrical force sensor). Electrical components 245*a* and 245*b* are electrically connected or electrically connectable with further electric circuitry such as an electrical control unit through conductors 246*a* and 246*b*. In one embodiment, component 245*a* is a piezo-electric actuator configured to lengthen or shorten the spacing between components 241 and 242*a* via the piezo-electric effect. In one embodiment, component 245*a* is an electro-magnetic motor, attached to component 242*a* such that a relative rotational motion between component 242*a* and the stator of component 245*a* is essentially prevented, e.g., by non-circularly-symmetric mechanical fittings, pins, screws, or glue. In one embodiment, the rotor of electro-magnetic motor 245*a* is threaded to form a lead screw, which inserts into a female thread as part of or attached to component 241, thereby enabling component 241 to move up and down with respect to components 242*a* and 245*a* depending on the rotation direction of the rotor relative to the stator. In one embodiment, the rotor of electro-magnetic motor 245*a* is attached to a lead screw, which inserts into a female thread as part of or attached to component 241, thereby enabling component 241 to move up and down with respect to components 242*a* and 245*a* depending on the rotation direction of the rotor relative to the stator.

Figure 2E:
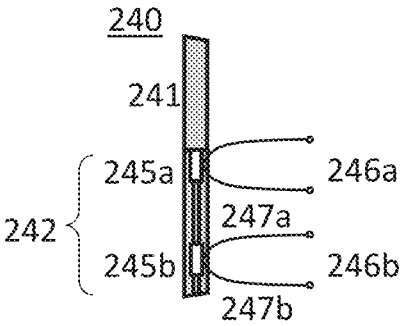

FIG. 2E shows an embodiment with two sound post components 241 and 242 and two electrical components 245*a* and 245*b* that are electrically connected or electrically connectable with further electric circuitry such as an electrical control unit through conductors 246*a* and 246*b* and that are embedded in component 242. In one embodiment, component 245*a* is a static or quasi-static electrical actuator, and component 245*b* is a static or quasi-static electrical pressure sensor (or static or quasi-static electrical force sensor). In one embodiment, component 245*a* is a piezo-electric actuator configured to lengthen or shorten the spacing between components 241 and 242 via the piezo-electric effect. In one embodiment, component 245*a* is an electro-magnetic motor, attached to component 242 such that a relative rotational motion between components 242 and the stator of component 245*a* is essentially prevented, e.g., by non-circularly-symmetric mechanical fittings, pins, screws, or glue. In one embodiment, the rotor of electro-magnetic motor 245*a* is threaded to form a lead screw, which inserts into a female thread as part of or attached to component 241, thereby enabling component 241 to move up and down with respect to component 242 depending on the rotation direction of the rotor relative to the stator. In one embodiment, the rotor of electro-magnetic motor 245*a* is attached to a lead screw, which inserts into a female thread as part of or attached to component 241, thereby enabling component 241 to move up and down with respect to component 242 depending on the rotation direction of the rotor relative to the stator. In one embodiment, embedded component 247*a* connects embedded static or quasi-static actuator 245*a* with embedded static or quasi-static sensor 245*b*. In one embodiment, embedded component 247*b* connects embedded static or quasi-static sensor 245*b* with a load-bearing surface of sound post component 242.

Figure 2F:
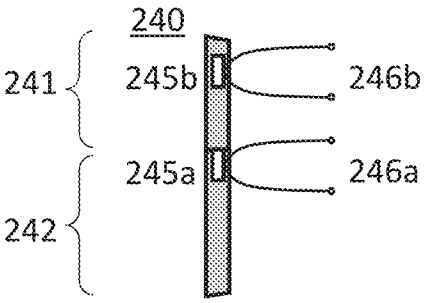

FIG. 2F shows an embodiment with two sound post components 241 and 242 and two electrical components 245*a* and 245*b* that are electrically connected or electrically connectable with further electric circuitry such as an electrical control unit through conductors 246*a* and 246*b*. Component 245*a* is embedded in component 242 and component 245*b* is embedded in component 241. In one embodiment, component 245*a* is a static or quasi-static electrical actuator and component 245*b* is a static or quasi-static electrical pressure sensor (or static or quasi-static electrical force sensor). In one embodiment, component 245*a* is a piezo-electric actuator configured to lengthen or shorten the spacing between components 241 and 242 via the piezo-electric effect. In one embodiment, component 245*a* is an electro-magnetic motor, attached to component 242 such that a relative rotational motion between components 242 and the stator of component 245*a* is essentially prevented, e.g., by non-circularly-symmetric mechanical fittings, pins, screws, or glue. In one embodiment, the rotor of electro-magnetic motor 245*a* is threaded to form a lead screw, which inserts into a female thread as part of or attached to component 241, thereby enabling component 241 to move up and down with respect to component 242 depending on the rotation direction of the rotor relative to the stator. In one embodiment, the rotor of electro-magnetic motor 245*a* is attached to a lead screw, which inserts into a female thread as part of or attached to component 241, thereby enabling component 241 to move up and down with respect to component 242 depending on the rotation direction of the rotor relative to the stator.

FIGS. 3A-3D show various exemplary embodiments 340 of mechanisms that may be used to change the length of various embodiments of sound post assemblies. Sound post assembly components 350 and 360 may correspond to any of, e.g., components 241, 242, 242*a*, 242*b*, 245, 245*a*, 245*b* of FIG. 2.

Figure 3A:
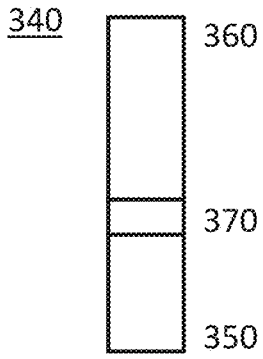
FIGS. 3A-3D show example embodiments of the mechanisms that can be used to change the length of the sound post assembly.

FIG. 3A shows an embodiment of mechanism 340, comprising sound post components 350 and 360. The separation of components 350 and 360 may be changed by inserting or removing one or more spacer elements 370 between components 350 and 360.

Figure 3B:
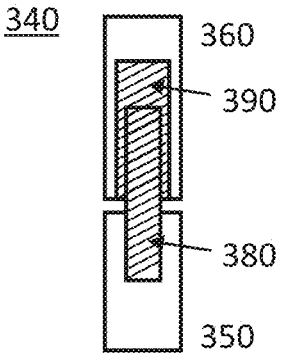

FIG. 3B shows an embodiment of mechanism 340, comprising sound post components 350 and 360. The separation of components 350 and 360 may be changed by a male lead screw 380 as part of or attached to sound post component 350. Lead screw 380 may be rotated relative to a female thread 390 as part of or attached to sound post component 360.

Figure 3C:
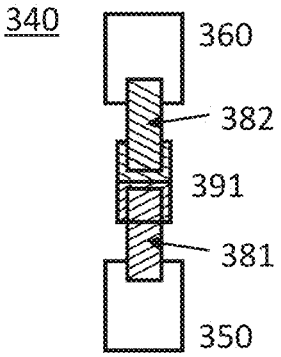

FIG. 3C shows an embodiment of mechanism 340, comprising sound post components 350 and 360. The separation of components 350 and 360 may be changed by a by a female threaded (e.g., double-threaded) part 391 that may be rotated relative to two (e.g., opposite-threaded) lead screws 381 and 382 that are, respectively, part of or attached to sound post components 350 and 360.

Figure 3D:
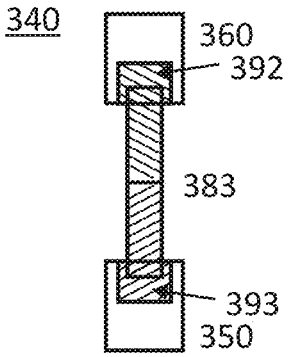

FIG. 3D shows an embodiment of mechanism 340, comprising sound post components 350 and 360. The separation of components 350 and 360 may be changed by a a (e.g., double-threaded) lead screw 383 that may be rotated relative to two (e.g., opposite-threaded) female threaded parts 392 and 393 that are, respectively, part of or attached to sound post components 350 and 360.

Figure 4A:
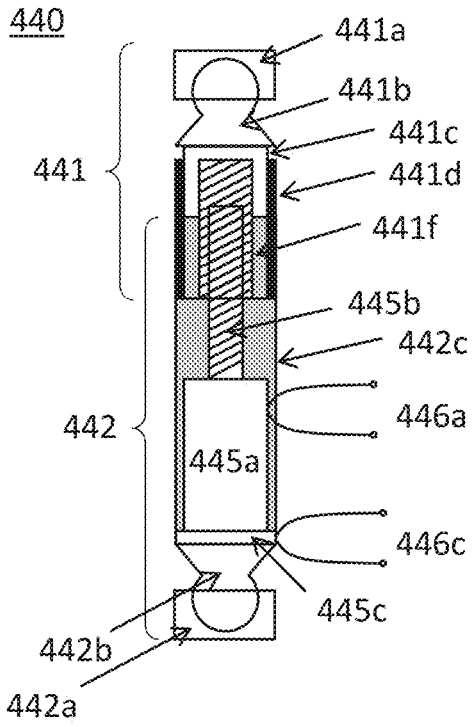
FIGS. 4A-4C show schematic views of a sound post according to some example embodiments.
Figure 4B:
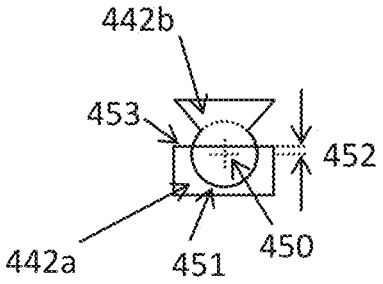

FIGS. 4A-4B show a sound post assembly according to yet another embodiment.

FIG. 4A shows an example embodiment of sound post assembly 440 that comprises two mechanical components 441 and 442. Components 441 and 442 are longitudinally movable relative to each other by having part 441*c* of component 441 slide within part 442*c* of component 442. The length of the overall assembly 440 may be controlled by lead screw 445*b* as part of the rotor of motor 445*a*, inserted into female thread 441*f* within part 441*c* of component 441. Static or quasi-static electrical force or pressure sensor 445*c* may be included within component 442, connecting parts 442*b* and 442*c*. Static or quasi-static electrical pressure or force sensor 445*c* may, e.g., be a thin resistive static or quasi-static electrical pressure and/or force sensor, e.g., such as the sensor "FexiForce" available through company TekScan of Boston, Mass., and may be glued to parts 442*b* and 442*c*. In some embodiments, sensor 445*c* may be implemented using the sensor unit 810 (FIGS. 8A-8B) and/or the sensor element 811 (FIG. 8C). The motor and sensor may, respectively, be electrically connected or electrically connectable through wires 446*a* and 446*c*. When installed in the instrument, lower ball socket 442*a* may rest on lower wall 150 of the instrument's sound box and upper ball socket 441*a* may rest on the upper wall of the instrument's sound box 130. In one embodiment, sensor 445*c* may be mounted between ball part 442*b* and motor enclosure 442*c*.

FIG. 4B shows an embodiment of a ball-socket swivel arrangement as part of an exemplary sound post assembly. Center 450 of spherical cavity 451 within socket part 442*a* may be located a distance 452 below the top rim 453 of part 442*a*, allowing the ball of part 442*b* to snap into socket without falling out during installation of the sound post assembly in the instrument. The same design may be used for the top ball-and-socket arrangement 441*a* and 441*b*.

Figure 4C:
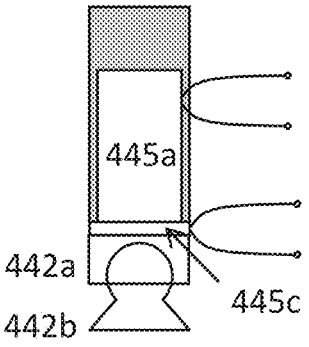

FIG. 4C shows yet another embodiment, in which the roles of parts 442*a* and 442*b* may be exchanged, i.e., part 442*b* may be configured to attach to the lower wall 150 of the instrument's sound box and part 442*a* may be attached to other parts of sound post component 442 such as electrical pressure sensor 445*c*. The same exchange of roles may be done for parts 441*a* and 441*b*.

Motor enclosure 442*c* may contain motor 445*a* in a way that prevents substantial rotational movement of the stator of motor 445*a* relative to motor enclosure 442*c* through, e.g., non-rotationally-symmetric mechanically fitting shapes, pins, screws, or glue. Sensor 445*c* may be connected to parts 442*b* and 442*c* in a way that substantially prevents rotational movements, e.g., through non-rotationally-symmetric mechanically fitting shapes, pins, screws, or glue. Hence, parts 442*b*, 445*c*, 445*a*, and 442*c* may be substantially rotationally locked relative to each other. Motor 445*a* may drive lead screw 445*b*, which may be inserted in a female thread within part 441*c* and may hence move part 441 up or down depending on the direction of the motor's rotation. Part 441*c* may slide within part 442*c* along a rotationally locking arrangement, such as key-and-slot arrangement 441*d* comprising of one or more keys sliding in one or more slots. (The functionality of an exemplary key-and-slot arrangement will become more apparent in the context of FIG. 5.) The use of equivalent rotationally locking sliding arrangements, such a pin-and-hole sliding mechanism, may alternatively be used. Hence, parts 442*c* and 441*c* may not exhibit a substantial rotational motion relative to each other, which increases the stability of sound post arrangement 440 during operation.

The parts constituting the sound post assembly may be manufactured out of various materials and combinations of materials, examples of which include wood, metal, plastic, or carbon (carbon-fiber reinforced plastics), all using appropriate additive or subtractive manufacturing techniques, such as machining, milling, routing, and 3D printing.

Figure 5A:
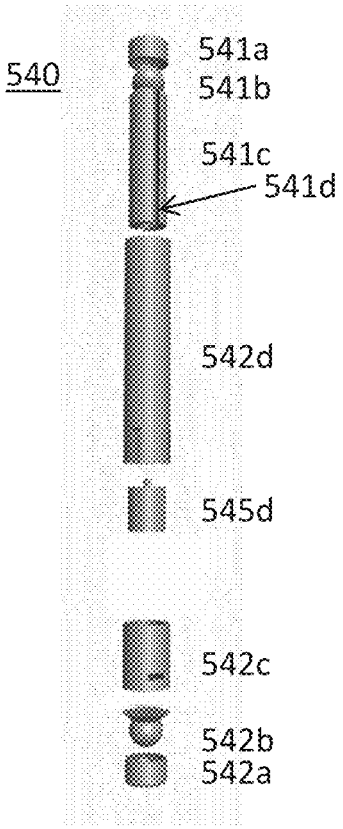
FIGS. 5A-5C show exploded views and certain parts of a sound post assembly according to some embodiments.
Figure 5B:
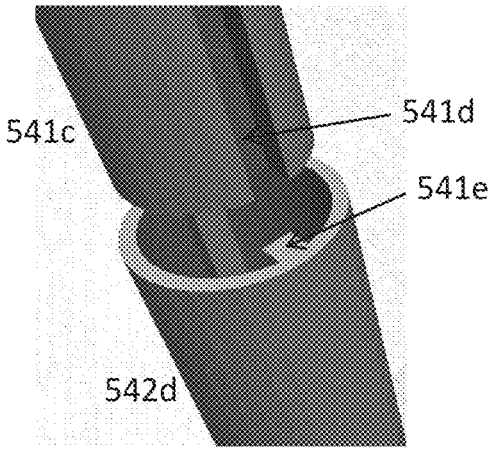

FIGS. 5A-5B show an explosion drawing of those parts 540 of an embodiment of a sound post assembly that may be manufactured in one embodiment using 3D printed plastic parts. Motor, sensor, lead screw, and female lead screw thread are therefore not shown as part of drawing FIGS. 5A-5B, as these may be made from metallic and composite parts in one embodiment, which are then inserted into the 3D printed plastic parts. Parts 541*a* and 542*a* are the socket parts resting on the upper and lower walls of the instrument's sound box. Parts 541*b* and 542*b* are the corresponding balls of the swivel arrangements formed by parts 541*a* and 541*b*, as well as by parts 542*a* and 542*b*. Parts 542*c* and 542*d* together make up the motor enclosure, 442*c*.

FIG. 5B shows an embodiment of a key-and-slot arrangement. Part 541*c* may contain two slots 541*d* that may in one embodiment be separated by 180 degrees. Keys 541*e* of part 542*d* slide into slots 541*d* to produce a key-and-slot sliding mechanism.

Figure 5C:
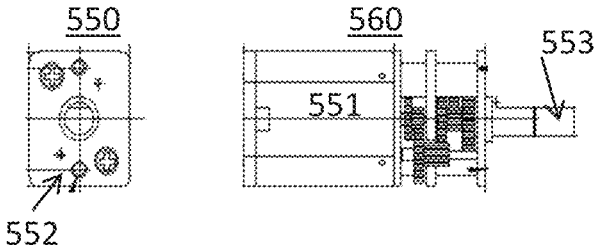

FIG. 5C shows top view 550 and side view 560 of an exemplary electro-magnetic motor assembly that may be used in one embodiment, available for sale, e.g., as a "Micro Gear Motor" from company Firgelli Automations. Stator 551 has a non-circularly symmetric cross-section and may be inserted into part 542*c* to essentially prevent relative rotational movement of motor assembly and sound post component 542*c*. Part 542*d* slides onto gear box 552 of the motor assembly, again preventing substantial relative rotational movement through the essentially rectangular cross-sectional shape of gear box 552. Part 545*d* connects motor shaft 553 and a metal lead screw.

Although various embodiments disclosed above may invoke sound post assemblies with essentially circular symmetry of most components, and in particular with circular symmetry of their end pieces that attach to the instrument's sound box across circular surfaces, other suitable cross-sectional shapes of one or more parts of the sound post assembly may be used, such as ellipses, or polygons with sharp or rounded corners. Such shapes, which are herewith included in this disclosure, may result in non-circular surfaces by which the sound post assembly attaches to the instrument's sound box. Further, the end pieces may be rounded towards the surface attaching to the instrument.

The sound post assembly disclosed in FIGS. 2 through 5 in some example, non-limiting embodiments, may be electrically connected or electrically connectable to an electrical control unit which may include such functions as reading out the static or quasi-static electrical sensor (e.g., its resistance), converting such raw read-outs into quantities of interest to the user (e.g., the sound post's static or quasi-static pressure or static or quasi-static force), displaying those quantities to the user, logging those quantities in a memory unit, and controlling the speed and direction of an actuator or motor based either on manual user input to the controller (e.g., by the user pressing motor control buttons in hardware or software) or based on algorithmically determined controls computed within the controller, by an associated local hardware, or by a remote hardware or software.

Figure 6A:
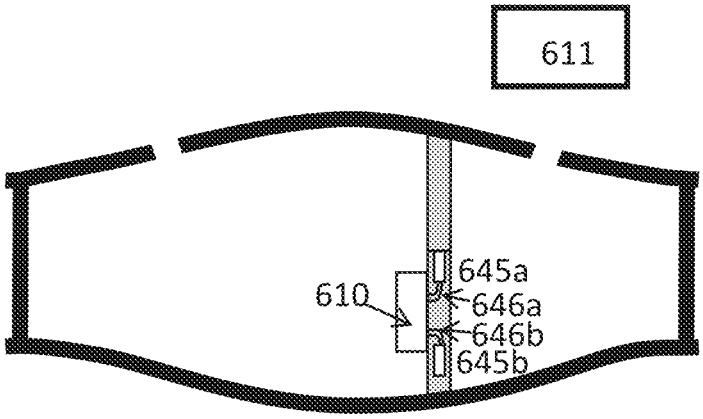
FIGS. 6A-6C show electrical wiring and user connector and control unit arrangements associated with a sound post assembly according to some embodiments.

FIG. 6A shows one embodiment, where electrical control unit 610 may be attached to the sound post assembly or may be located in close vicinity to the sound post assembly inside the instrument's sound box. Electrical control unit 610 may be electrically connected to one or more electrical sound post components 645*a* and 645*b* (referred to as 645 in FIG. 6C) through electrical conductors 646*a* and 646*b*, may be battery-powered, and may be wirelessly interfaced to, e.g., an external user device 611, which in some embodiment may be a smart phone or a computer.

Figure 6B:
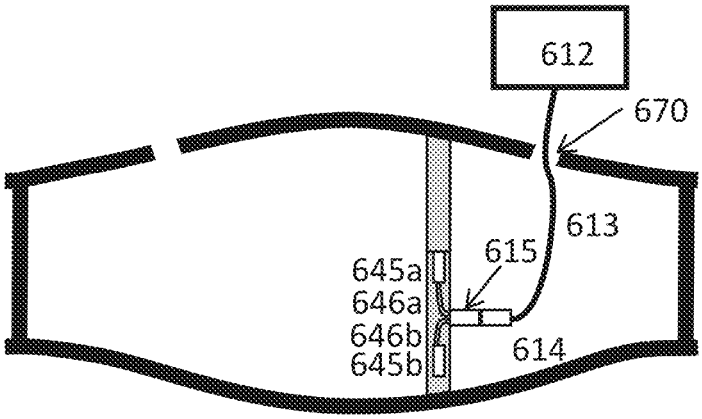
Figure 6C:
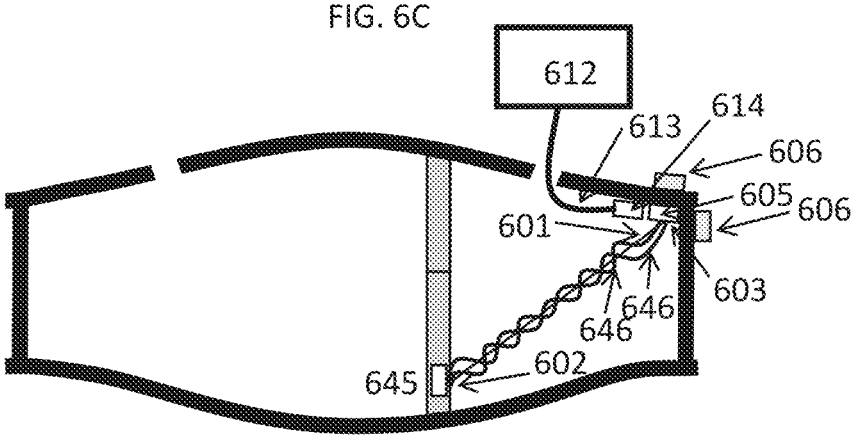

As shown in FIGS. 6B-C, in some embodiments a control unit 612 may be located outside the instrument and may be permanently or temporarily electrically connected to the sound post assembly, using electrical conductors such as wires, metal foils, or solid metal parts. This may be accomplished, e.g.:

(i) as shown in one embodiment in FIG. 6B, by inserting a cable 613 through f-hole 670 into the sound box and electrically connecting that cable via connector part 614 to its connector counterpart 615. Connector counterpart 615 may be electrically connected to one or more sound post components, in one embodiment to components 645*a* and 645*b* through electrical conductors 646*a* and 646*b*. Connector counterpart 615 may be attached to the sound post assembly as shown in FIG. 6B or may be placed in close proximity to the sound post assembly;

(ii) as shown in one embodiment in FIG. 6C by one or more electric wires or one or more electric wire pairs 646 strung within the sound box from one or more locations on the sound post assembly to one or more locations within the sound box, where connector counterpart 605 is being placed, such as the end pin or button 180, locations in close proximity to one of the f-holes 170, or locations in close proximity to one of the instrument's corners 171. Such locations are suitable for attaching wire connectors through friction (e.g., clamping them between the end pin and the instrument's body); through gluing or taping; or through a magnetically-assisted mechanism, e.g., by placing one or more magnets 606 onto the outside of the instrument's sound box to hold connector counterpart 605 (which in this case contains magnetic materials) at the desired location within the sound box. Connector counterpart 605 mounted inside the sound box may be accessible to a user to electrically connect control unit 612 via cable 613 and connector part 614.

(ii) in one embodiment, re-using existing metallic parts that connect the inside of the instrument's sound box to its outside, embodiments of which include metallic, partially metallic, or wired versions of end pins of a cello or double bass as well as buttons or end pins of a violin or viola;

In one embodiment, as shown in FIG. 6C, if strung wiring is used within the sound box, it is beneficial to loosely coil the wires 646 around an elastic material 601, e.g., a rubber band, a plastic spring, or a metallic spring, to keep the loosely coiled wires 646 along a substantially straight line between their connection points 602 on or near the sound post assembly and their connection points 603 at connector counterpart 605. In some embodiments, the length of the elastic material around which wires are loosely coiled may be extendable by at least 10% relative to its non-extended length. In some embodiments, the length of the elastic material around which wires are loosely coiled may be extendable by at least 25% relative to its non-extended length. Such an elastic mechanism allows placement of the sound post assembly at different locations within the instrument without coiled wires 646 involuntarily touching parts of the instrument and thereby creating spurious noises.

As used herein, the term "static or quasi-static electrical force sensor" refers to a device or circuit element that can change one or more of its electrical properties (e.g., a resistance, a capacitance, and/or an inductance) in response to a static or quasi-static mechanical force applied to the sensor. In operation, e.g., when assisted by a corresponding electrical read-out circuit, a static or quasi-static electrical force sensor may produce one or more static or quasi-static electrical signals (e.g., a current or a voltage) for readout. In an example embodiment, a static or quasi-static electrical force sensor is designed and configured to effectively convert a static or quasi-static mechanical force applied thereto into one or more corresponding static or quasi-static electrical signals while being ineffective in (e.g., incapable of) converting dynamic force variations into corresponding dynamically varying electrical signals or fast electrical-signal variations. In some cases, a static or quasi-static electrical force sensor may be configured to operate as a static or quasi-static electrical pressure sensor. In such cases, the force-receiving area of the sensor may be relatively uniformly force-loaded such that the corresponding pressure across the force-receiving area may be relatively accurately estimated by dividing the measured force by the force-receiving area of the sensor. In such cases, a person of ordinary skill in the pertinent art will be able to (re)calibrate a force sensor and then use it as a pressure sensor without any undue experimentation.

A static or quasi-static electrical force sensor may be compared and contrasted with an "electrical sound pick-up" or an acoustic microphone often used in acoustic applications. For example, an electrical sound pick-up is a device or circuit element designed and configured to effectively convert dynamic mechanical-pressure variations into one or more corresponding, time-dependent, fast-changing electrical signals while being ineffective in (e.g., incapable of) converting static or quasi-static pressures into the corresponding static or quasi-static electrical signals. For example, an electrical sound pick-up or an acoustic microphone may be sensitive to mechanical pressure variations in the acoustic frequency range between about 20 Hz and 20 kHz while being insensitive to mechanical pressure variations in the frequency range below about 20 Hz. The energy of the corresponding electrical signal generated by such electrical sound pick-up or microphone is thus typically spectrally confined (e.g., has more than 90% of its energy) in the frequency range between about 20 Hz and 20 kHz.

In normal operation, the sound post of a stringed musical instrument may convey, from an upper wall to a lower wall of a sound box thereof, a combination of a static force and dynamically varying pressure having characteristic frequencies in the above-indicated acoustic range. While the static force is present irrespective of whether the instrument is being played or not, the dynamically varying pressure is typically only produced by playing or by otherwise dynamically exciting the instrument.

In example embodiments, static or quasi-static electrical force sensors may be constructed such as to effectively convert a static or quasi-static mechanical force (or a static or quasi-static mechanical pressure) into one or more corresponding static or quasi-static electrical signals. For example, an output voltage produced by such a sensor may be a substantially linear function of (e.g., proportional to) of the applied static or quasi-static mechanical force. Hence, static or quasi-static electrical force sensors may rely on static or quasi-static electro-mechanical conversion mechanisms, such as a change in resistance, inductance, or capacitance of the sensor element. For example, the resistive static or quasi-static electrical force sensor "FlexiForce" available through the company TekScan of Boston, Mass., may comprise two plate-like metallic electrodes in-between which an electrically conductive (e.g., piezoresistive) ink is placed, whereby the electrical resistance of the metal-ink-metal structure may vary with the mechanical force (or pressure) applied to the sensor element. In some embodiments, a sensor may be connected to one or more analog or digital electrical low-pass filters such as to produce a static or quasi-static electrical signal at the output of the combined sensor/filter circuit.

In contrast, a sound pick-up is typically constructed to have a natural high-pass or band-pass characteristic, i.e., a sound pick-up may have a lower cut-off frequency below which it is ineffective in converting acoustic vibrations into some form of variations of the output electrical signal(s). Such cut-off frequencies are typically in the 15 Hz to 20 Hz range, which makes sound pick-ups by themselves unsuitable to act as static or quasi-static force or pressure sensors. For example, a conventional sound pick-up may not function as a suitable substitute for one of the above-mentioned "FlexiForce" sensors.

Herein, a force sensor is referred to as "static force sensor" when the characteristic response time to a step-like change of the loading force is longer than about 10 seconds. A force sensor is referred to as "quasi-static force sensor" when the characteristic response time to a step-like change of the loading force is between about 10 seconds and about one tenth of a second.

Figure 7A:
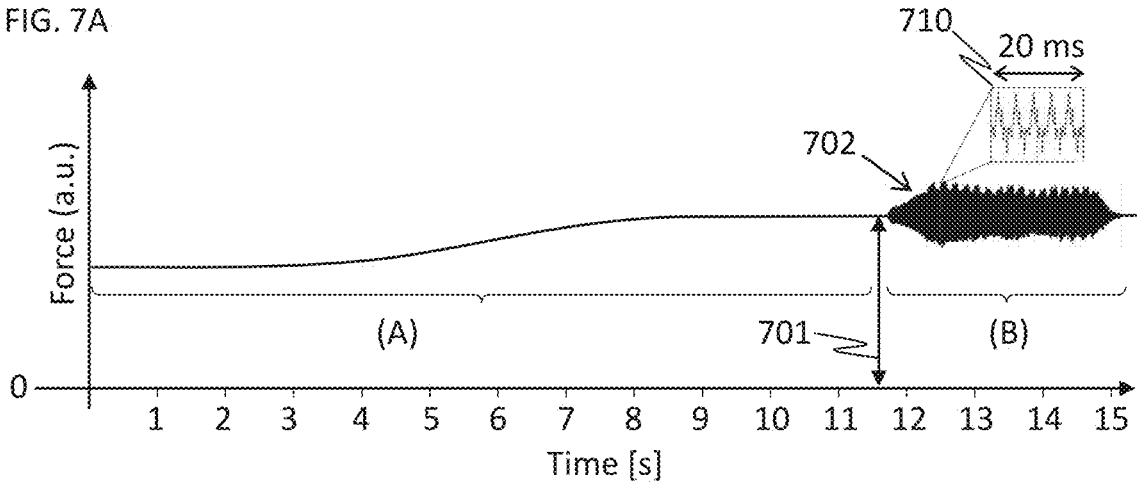
FIGS. 7A-7B graphically illustrate certain characteristics of a static or quasi-static electrical force sensor that can be used in a sound post according to an embodiment.
Figure 7B:
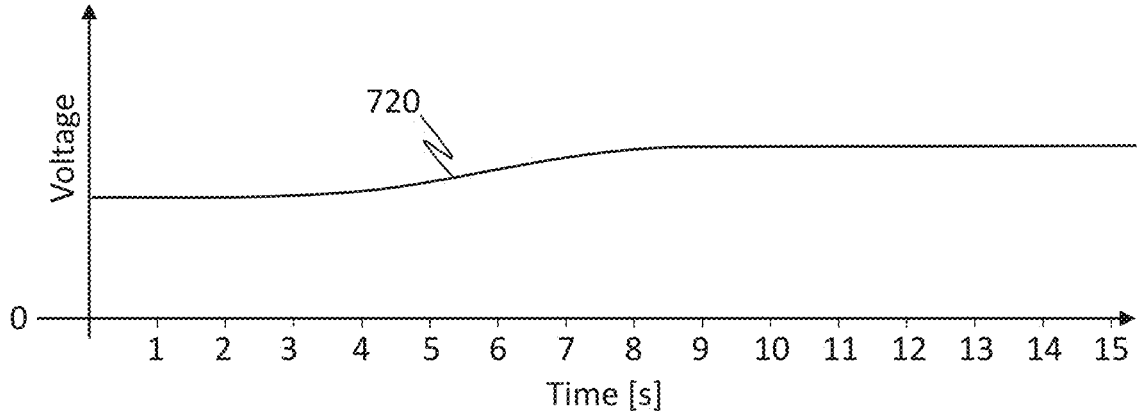

FIGS. 7A-7B graphically illustrate certain characteristics of a static or quasi-static electrical force sensor that can be used in a sound post (e.g., 240, 340, or 440) according to an embodiment.

FIG. 7A graphically shows an example composite sound post force as a function of time, as exerted by a sound post of a stringed musical instrument inserted between an upper wall and a lower wall of the instrument's sound box. Two example time intervals, labeled A and B are shown. More specifically, during the time interval A, the instrument is not being played. In contrast, during the time interval B, the instrument is being played. During the time interval A, the force applied to the sensor is quasi-static. During the time interval B, the force applied to the sound post contains a static component 701 and a dynamically varying component 702. Inset 710 displays a short (20 millisecond) time segment of the dynamically varying component 702.

FIG. 7B graphically shows an electrical signal (e.g., a voltage signal) 720 at the output of the force sensor used in the sound post, whereby the force sensor is subjected to the conditions illustrated in FIG. 7A. As can be seen in FIG. 7B, acoustic vibrations corresponding to the component 702 do not manifest themselves in the electrical signal 720, e.g., due to being filtered out or suppressed by the signal conversion implemented in the sensor. In contrast, the component 702 causes the electrical signal 720 to have the corresponding static and, at some times, quasi-static electrical component.

Figure 8A:
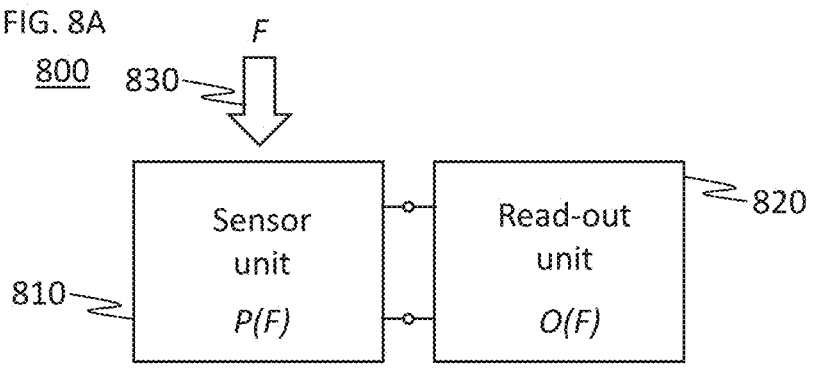
FIGS. 8A-8C show block diagrams of electrical circuits that can be used in some embodiments.
Figure 8B:
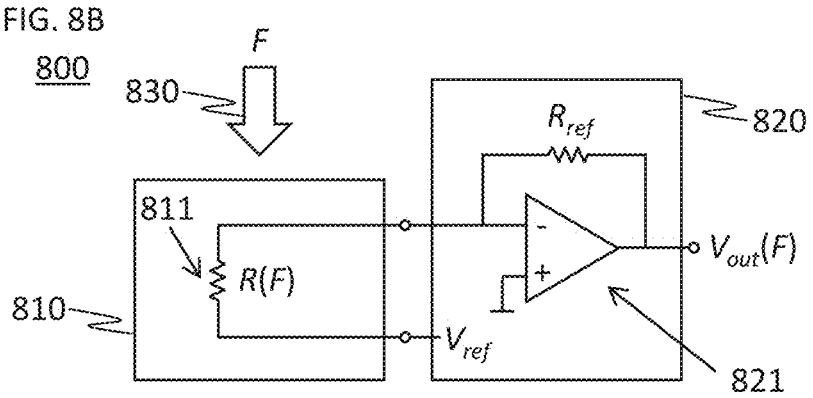
Figure 8C:
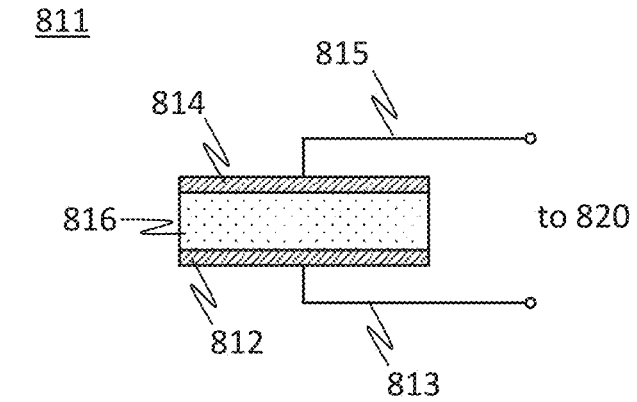

FIGS. 8A-8C show block diagrams of electrical circuits that can be used in some embodiments.

FIG. 8A shows a block diagram of an electrical circuit 800 according to an embodiment. Circuit 800 comprises a static or quasi-static force-sensor unit 810 and an electrical read-out unit 820. In some embodiments, a sound post may include unit 810 but not unit 820. In some embodiments, a sound post may include unit 810 and some portions of (e.g., parts of the electrical circuit(s) used in) unit 820.

A static or quasi-static force 830 (denoted as F) applied to the sensor unit 810 causes corresponding changes in a static or quasi-static electrical parameter P according to a transfer function of the force F, i.e., P=P(F). In various embodiments, the parameter P may be a resistance, a capacitance, or an inductance of the sensor element. In some alternative embodiments, the parameter P may be a resonance frequency of the sensor element. The read-out unit converts the electrical parameter P(F) into an output O(F) indicative of the magnitude of the force 830. In some embodiments, the output O(F) may be a voltage or a current. In some other embodiments, the output O(F) may be a digital value displayed on a digital display.

FIG. 8B shows a block diagram of a specific embodiment of circuit 800, wherein unit 810 comprises a sensor element 811 implemented as a pressure-dependent resistor R(F). Unit 820 comprises an electrical amplifier 821 connected to measure the resistance of sensor element 811 using a reference voltage $V_{ref}$. In operation, the shown unit 820 may generate an output voltage $V_{out}(F)$, which can be used to determine the value R(F) in accordance with the following formula:

$$V_{out}(F)=-V_{ref}\times R_{ref}/R(F)$$

where $R_{ref}$ is a reference resistor.

In an example embodiment, circuit 800 has a static or quasi-static transfer function in the sense of the term "static or quasi-static" explained above. In some embodiments, circuit 800 may not have a lower cut-off frequency, i.e., is designed to respond to arbitrarily low-frequency variations of the applied force F. In some embodiments, circuit 800 may have a cut-off frequency of 100 mHz (Milli-Hertz), as it may take pressure-dependent resistor R(F), e.g., 10 seconds to reach a representative steady-state resistance once a change of the force F is effected.

In some alternative embodiments, more complex circuits, e.g., using capacitive, inductive, or resonance-frequency based sensor elements may be used. Some embodiments of circuit 800 may rely on an electrical excitation of the corresponding sensor element by various electrical stimulus frequencies generated using the read-out unit 820. Such excitation with the stimulus frequencies may typically render the sensor unit 810 unsuitable for sound pick-up.

FIG. 8C shows a cross-sectional view of sensor element 811 according to an embodiment. Sensor element 811 comprises a layer 816 of a piezoresistive material sandwiched between metal electrodes 812 and 814. Electrical leads 813 and 815 are used to connect the metal electrodes 812 and 814 to other pertinent circuits, e.g., to the unit 820, as indicated in FIG. 8C. In various embodiments, a piezoresistive material used in layer 816 may comprise a semiconductor material, a metal or metal alloy, a polymer, a viscous fluid, and/or a composite material. In operation, the sensor element of FIG. 8C may exhibit characteristics similar to those graphically illustrated in FIGS. 7A-7B.

Figure 9A:
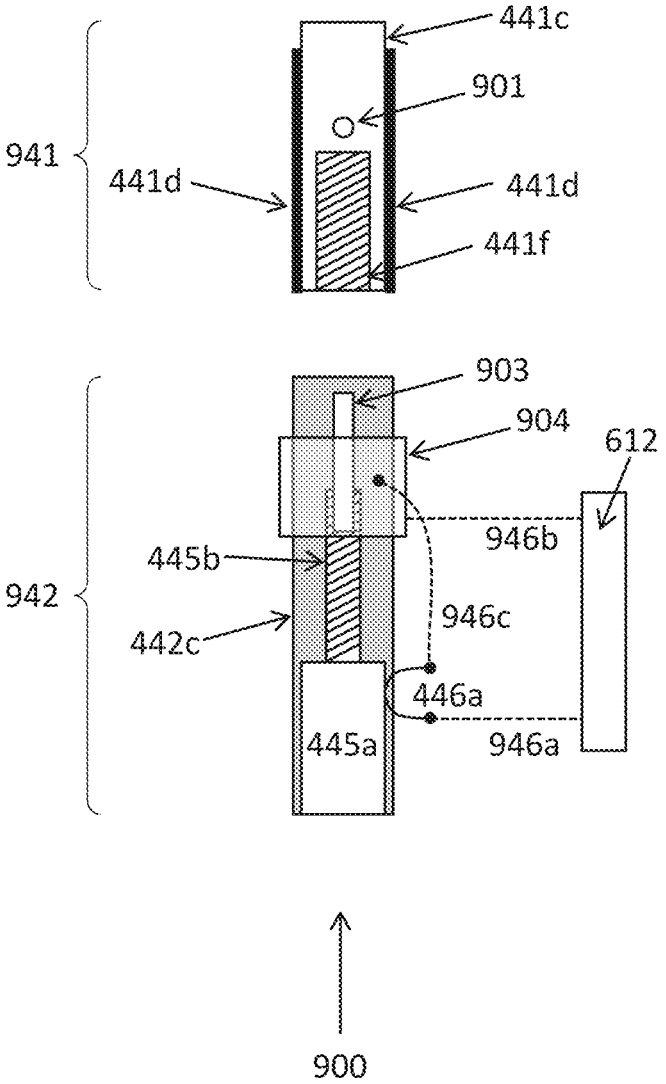
FIGS. 9A-9B show side and top views of a sound post according to yet another embodiment.
Figure 9B:
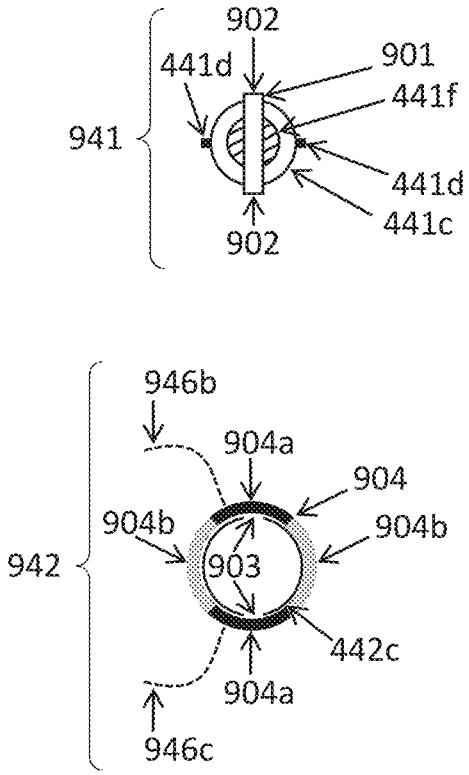

FIGS. 9A-9B show side and top views, respectively, of a sound post according to yet another embodiment. More specifically, FIG. 9A shows a cross-sectional sideview 910, and FIG. 9B shows a top view 920, of both portions of a sound post according to an embodiment. In the shown embodiment, the sound post comprises a mechanism that prevents the assembly from being accidentally elongated beyond a pre-determined maximum length, e.g., to a point where the wood making up the top or the bottom of the instrument's sound box might crack due to the excessive sound post pressure. In some embodiments, the shown mechanism may be adjustable to change the pre-determined maximum length. Such adjustments can be made, e.g., prior to installing and operating the corresponding sound-post assembly in the musical instrument.

In operation, once the sound post assembly reaches the pre-determined maximum length, the damage-prevention mechanism of the shown embodiment breaks the electrical circuit supplying the motor with electrical power, e.g., directly on the sound post. In particular, a first sound post component 941 may include a part 441*c* with female thread 441*f* as well as a rotationally locking arrangement, such as key-and-slot arrangement 441*d* comprising one or more keys sliding in one or more slots as described in connection with FIG. 4A. In operation, the sound post component 941 slides into a second sound post component 942, which may comprise a part 442*c*, a lead screw 445*b* matching female thread 441*f*, and a motor 445*a*. In operation, the length of the overall assembly 900 (including connected components 941 and 942) may be controlled by turning clockwise or counter-clockwise lead screw 445*b* as part of the rotor of motor 445*a*, inserted into female thread 441*f*. In some embodiments, the sound post component 941 may further comprise an electrical contact rod 901. Electrical contact rod 901 may be fabricated from any electrically conducting material or may be made from a non-conducting material and include electrically conducting paths (e.g. metal wires or metal traces) between its two electrically conducting end faces 902. Sound post part 442*c* may comprise diametrically opposed longitudinal slits 903, in which contact rod 901 may slide up and down during operation, while the sound post assembly extends and contracts in length. Further, sound post part 442*c* may comprise a sleeve 904. Sleeve 904 may comprise two diametrically opposed electrically conductive portions 904*a*, which are separated by two electrically insulating portions 904*b*.

In operation, electrical current may be supplied to motor 445*a* as follows: A first of motor wires 446*a* is electrically connected to a control unit, e.g. to control unit 612, through an electrical conductor 946*a* (e.g., a wire or an electrical foil). A second of motor wires 446*a* is electrically connected to a first electrically conductive portion 904*a* of sleeve 904 through an electrical conductor 946*c*. If the longitudinal position of contact rod 901 overlaps with the longitudinal position of sleeve 904, then the first electrically conductive portion 904*a* of sleeve 904 is electrically connected to a second electrically conductive portion 904*a* of sleeve 904 through contact rod 901. The second electrically conductive portion 904*a* of sleeve 904 is connected to a control unit, e.g. to control unit 612, through an electrical conductor 946*b*, thus completing the electrical circuit and enabling the same to supply motor 445*a* with electrical power. If the sound post assembly extends beyond the length where contact rod 901 makes contact with sleeve 904, then the electrical circuit supplying motor 445*a* with electrical power is broken and no further sound post extensions can inadvertently be made.

In some embodiments, sleeve 904 may be configured to be longitudinally movable along sound post part 442*c* so as to adjust the maximally allowed sound post extension specific to the respective instrument that the sound post is inserted in. In some embodiments, sleeve 904 may be configured to slide up and down sound post part 442*c*. In some embodiments, sleeve 904 may be held in place by mechanical friction. In some embodiments, sleeve 904 may be held in place by affixing sleeve 904 to sound post part 442*c* at the desired location using glue. In some embodiments, sleeve 904 may have an inner thread and sound post part 442*c* may have an outer thread, which allows the position of sleeve 904 to be adjusted by turning sleeve 904 clockwise or counter-clockwise on sound post part 442*c*. In some embodiments, contact rod 901 may further comprise an elastic mechanism that in operation pushes conducting end faces 902 against sleeve 904. For example, in some embodiments, end faces 902 may comprise conducting elastic contact brushes. In some other embodiments, end faces 902 may be spring-loaded relative to each other or relative to contact rod 901, such as to exert an outward pushing force onto end faces 902.

According to an example embodiment disclosed above, e.g., in the summary section and/or in reference to any one or any combination of some or all of FIGS. 1-9, provided is a stringed musical instrument comprising: a sound box (e.g., 160, FIG. 1A) having an inner cavity bounded by an upper wall (e.g., 130, FIG. 1A) and a lower wall (e.g., 150, FIG. 1A) thereof; a sound-post assembly (e.g., 440, FIG. 4A) having ends thereof connecting directly (e.g., 140*a*, FIG. 1D) or indirectly (e.g., 140*b*, FIG. 1D) the upper and lower walls in the inner cavity, the sound post assembly including two or more mechanical components (e.g., 441, 442, FIG. 4A) movable with respect to one another to change an end-to-end length of the sound-post assembly; and wherein the sound-post assembly comprises a first electrical component (e.g., 445*a* or 445*c*, FIG. 4A).

In some embodiments of any of the above stringed musical instruments, the first electrical component is electrically connectable to an electrical circuit (e.g., 610, 612, FIG. 6).

In some embodiments of any of the above stringed musical instruments, the two or more mechanical components are configured to accommodate one or more removable spacer elements therebetween to change the end-to-end length (e.g., 340, FIG. 3).

In some embodiments of any of the above stringed musical instruments, the two or more mechanical components include a lead screw and a female threaded part mated to be relatively rotatable to change the end-to-end length (e.g., 380, 390, FIG. 3B).

In some embodiments of any of the above stringed musical instruments, the first electrical component comprises a static or quasi-static electrical pressure sensor (e.g., 445*c*, FIG. 4A).

In some embodiments of any of the above stringed musical instruments, the static or quasi-static electrical pressure sensor is configured to change one or more of: an electrical resistance thereof; an electrical capacitance thereof; an electrical inductance thereof, in response to a physical pressure applied thereto.

In some embodiments of any of the above stringed musical instruments, the first electrical component comprises a static or quasi-static electrical actuator (e.g., 445*a*, FIG. 4A) configured to change the end-to-end length of the sound post assembly.

In some embodiments of any of the above stringed musical instruments, the static or quasi-static electrical actuator comprises a piezoelectric material.

In some embodiments of any of the above stringed musical instruments, the static or quasi-static electrical actuator comprises an electro-magnetic motor connected to a lead screw arrangement (e.g., 445*a*, 445*b*, 441*f*, FIG. 4A).

In some embodiments of any of the above stringed musical instruments, the two or more mechanical components are mechanically engaged using a key-and-slot arrangement (541*d*, 541*e*, FIG. 5B) or a pin-and-hole arrangement to restrict relative rotational motion thereof.

In some embodiments of any of the above stringed musical instruments, the sound-post assembly comprises a second electrical component (e.g., the other one of 445*a*, 445*c*, FIG. 4A) configured to be electrically connectable to an electrical circuit (e.g., 610, 612, FIG. 6).

In some embodiments of any of the above stringed musical instruments, the first electrical component comprises a static or quasi-static electrical pressure sensor, and the second electrical component comprises a static or quasi-static electrical actuator (e.g., 445*a* and 445*c*, FIG. 4A).

In some embodiments of any of the above stringed musical instruments, the stringed musical instrument further comprises a wall-mounted electrical connector (e.g., 605, FIG. 6C) connected by electrical wires (e.g., 646, FIG. 6C) to the first electrical component.

In some embodiments of any of the above stringed musical instruments, the wall-mounted electrical connector comprises a static magnet.

In some embodiments of any of the above stringed musical instruments, the wall-mounted electrical connector comprises a static magnet placed on the outside of the soundbox (e.g., 606, FIG. 6C).

In some embodiments of any of the above stringed musical instruments, the electrical wires are coiled around an elastic mechanical element (e.g., 646, 601, FIG. 6C).

In some embodiments of any of the above stringed musical instruments, the two or more mechanical components include a swivel end cap (e.g., 442*a*, 442*b*, FIG. 4).

In some embodiments of any of the above stringed musical instruments, the two or more mechanical components include a swivel mechanism formed by a ball-and-socket arrangement; and wherein a center of a spherically shaped cavity of the socket is located below a rim of the swivel end cap by at least 10% of the sphere's radius (e.g., 452, FIG. 4B).

According to another example embodiment disclosed above, e.g., in the summary section and/or in reference to any one or any combination of some or all of FIGS. 1-9, provided is a sound-post assembly (e.g., 440, FIG. 4A) for a stringed musical instrument, the sound-post assembly comprising: two or more mechanical components (e.g., 441, 442, FIG. 4A) movable with respect to one another to change an end-to-end length of the sound-post assembly; and a first electrical component (e.g., 445*a* or 445*c*, FIG. 4A); wherein ends of the sound-post assembly are configured to connect directly (e.g., 140*a*, FIG. 1D) or indirectly (e.g., 140*b*, FIG. 1D) the upper and lower walls of an inner cavity of a sound box of the stringed musical instrument; and wherein the first electrical component is electrically connectable to an electrical circuit (e.g., 610, 612, FIG. 6).

In some embodiments of any of the above sound post assemblies, the two or more mechanical components are configured to accommodate one or more removable spacer elements therebetween to change the end-to-end length (e.g., 370, FIG. 3A).

In some embodiments of any of the above sound post assemblies, the two or more mechanical components include a lead screw and a female threaded part mated to be relatively rotatable to change the end-to-end length (e.g., 380, 390, FIG. 3B).

In some embodiments of any of the above sound post assemblies, the first electrical component comprises a static or quasi-static electrical pressure sensor (e.g., 445*c*, FIG. 4A).

In some embodiments of any of the above sound post assemblies, the static or quasi-static electrical pressure sensor is configured to change one or more of: an electrical resistance thereof; an electrical capacitance thereof; an electrical inductance thereof, in response to a static or quasi-static physical pressure applied thereto.

In some embodiments of any of the above sound post assemblies, the first electrical component comprises a static or quasi-static electrical actuator (e.g., 445*a*, FIG. 4A) configured to change the end-to-end length of the sound post assembly.

In some embodiments of any of the above sound post assemblies, the static or quasi-static electrical actuator comprises a piezoelectric material.

In some embodiments of any of the above sound post assemblies, the static or quasi-static electrical actuator comprises an electro-magnetic motor connected to a lead screw arrangement (e.g., 445*a*, 445*b*, 441*f*, FIG. 4A).

In some embodiments of any of the above sound post assemblies, the two or more mechanical components are mechanically engaged using a key-and-slot arrangement (541*d*, 541*e*, FIG. 5B) or a pin-and-hole arrangement to restrict relative rotational motion thereof.

In some embodiments of any of the above sound post assemblies, the sound-post assembly comprises a second electrical component (e.g., the other one of 445*a*, 445*c*, FIG. 4A) configured to be electrically connectable to an electrical circuit (e.g., 610, 612, FIG. 6).

In some embodiments of any of the above sound post assemblies, the first electrical component comprises a static or quasi-static electrical pressure sensor, and the second electrical component comprises a static or quasi-static electrical actuator (e.g., 445*a* and 445*c*, FIG. 4A).

In some embodiments of any of the above sound post assemblies, the sound post assembly further comprises a wall-mounted electrical connector (e.g., 605, FIG. 6C) connected by electrical wires (e.g., 646, FIG. 6C) to the first electrical component.

In some embodiments of any of the above sound post assemblies, the wall-mounted electrical connector comprises a static magnet.

In some embodiments of any of the above sound post assemblies, the wall-mounted electrical connector comprises a static magnet placed on the outside of the soundbox (e.g., 606, FIG. 6C).

In some embodiments of any of the above sound post assemblies, the electrical wires are coiled around an elastic mechanical element (e.g., 646, 601, FIG. 6C).

In some embodiments of any of the above sound post assemblies, the two or more mechanical components include a swivel end cap (e.g., 442*a*, 442*b*, FIG. 4).

In some embodiments of any of the above sound post assemblies, the two or more mechanical components include a swivel mechanism formed by a ball-and-socket arrangement; and wherein a center of a spherically shaped cavity of the socket is located below a rim of the swivel end cap by at least 10% of the sphere's radius (e.g., 452, FIG. 4B).

According to yet another example embodiment disclosed above, e.g., in the summary section and/or in reference to any one or any combination of some or all of FIGS. 1-9, provided is an apparatus, comprising: a sound-post assembly (e.g., 440, FIG. 4A) for a stringed musical instrument; and a control unit (e.g., 610, 612, FIG. 6) to electrically interface to one or more functions of the sound-post assembly; wherein sound-post assembly comprises: two or more mechanical components (e.g., 441, 442, FIG. 4A) movable with respect to one another to change an end-to-end length of the sound-post assembly; and a first electrical component (e.g., 445*a* or 445*c*, FIG. 4A); wherein ends of the sound-post assembly are configured to connect directly (e.g., 140*a*, FIG. 1D) or indirectly (e.g., 140*b*, FIG. 1D) the upper and lower walls of an inner cavity of a sound box of the stringed musical instrument; and wherein the first electrical component is electrically connectable to the control unit.

In some embodiments of any of the above apparatus, the two or more mechanical components are configured to accommodate one or more removable spacer elements therebetween to change the end-to-end length (e.g., 370, FIG. 3A).

In some embodiments of any of the above apparatus, the two or more mechanical components include a lead screw and a female threaded part mated to be relatively rotatable to change the end-to-end length (e.g., 380, 390, FIG. 3B).

In some embodiments of any of the above apparatus, the first electrical component comprises a static or quasi-static electrical pressure sensor (e.g., 445*c*, FIG. 4A).

In some embodiments of any of the above apparatus, the a static or quasi-static electrical pressure sensor is configured to change one or more of: an electrical resistance thereof; an electrical capacitance thereof; an electrical inductance thereof, in response to a static or quasi-static physical pressure applied thereto.

In some embodiments of any of the above apparatus, the control unit is configured read a static or quasi-static pressure sensor data from the a static or quasi-static electrical pressure sensor.

In some embodiments of any of the above apparatus, the first electrical component comprises a static or quasi-static electrical actuator (e.g., 445*a*, FIG. 4A) configured to change the end-to-end length of the sound post assembly.

In some embodiments of any of the above apparatus, the static or quasi-static electrical actuator comprises a piezoelectric material.

In some embodiments of any of the above apparatus, the static or quasi-static electrical actuator comprises an electromagnetic motor connected to a lead screw arrangement (e.g., 445*a*, 445*b*, 441*f*, FIG. 4A).

In some embodiments of any of the above apparatus, the control unit is configured apply an electrical control signal to the static or quasi-static electrical actuator.

In some embodiments of any of the above apparatus, the two or more mechanical components are mechanically engaged using a key-and-slot arrangement (541*d*, 541*e*, FIG. 5B) or a pin-and-hole arrangement to restrict relative rotational motion thereof.

In some embodiments of any of the above apparatus, the sound-post assembly comprises a second electrical component (e.g., the other one of 445*a*, 445*c*, FIG. 4A) configured to be electrically connectable to an electrical circuit (e.g., 610, 612, FIG. 6).

In some embodiments of any of the above apparatus, the first electrical component comprises a static or quasi-static electrical pressure sensor, and the second electrical component comprises a static or quasi-static electrical actuator (e.g., 445*a* and 445*c*, FIG. 4A).

In some embodiments of any of the above apparatus, the control unit operates a static or quasi-static electrical pressure sensor and static or quasi-static electrical actuator in a closed-loop setting to maintain a user-specified a static or quasi-static sound post assembly pressure within a user-specified a static or quasi-static pressure range.

In some embodiments of any of the above apparatus, the apparatus further comprises a wall-mounted electrical connector (e.g., 605, FIG. 6C) connected by electrical wires (e.g., 646, FIG. 6C) to the first electrical component.

In some embodiments of any of the above apparatus, the wall-mounted electrical connector comprises a static magnet.

In some embodiments of any of the above apparatus, the wall-mounted electrical connector comprises a static magnet placed on the outside of the soundbox (e.g., 606, FIG. 6C).

In some embodiments of any of the above apparatus, the electrical wires are coiled around an elastic mechanical element (e.g., 646, 601, FIG. 6C).

In some embodiments of any of the above apparatus, the two or more mechanical components include a swivel end cap (e.g., 442*a*, 442*b*, FIG. 4).

In some embodiments of any of the above apparatus, the two or more mechanical components include a swivel mechanism formed by a ball-and-socket arrangement; and wherein a center of a spherically shaped cavity of the socket is located below a rim of the swivel end cap by at least 10% of the sphere's radius (e.g., 452, FIG. 4B).

According to yet another example embodiment disclosed above, e.g., in the summary section and/or in reference to any one or any combination of some or all of FIGS. 1-9, provided is a stringed musical instrument, comprising: a sound box (e.g., 160, FIG. 1A) having an inner cavity bounded by an upper wall (e.g., 130, FIG. 1A) and a lower wall (e.g., 150, FIG. 1A) thereof; a sound-post assembly (e.g., 440, FIG. 4A) having ends thereof connecting directly (e.g., 140*a*, FIG. 1D) or indirectly (e.g., 140*b*, FIG. 1D) the upper and lower walls in the inner cavity, the sound post assembly including two or more mechanical components (e.g., 441, 442, FIG. 4A) movable with respect to one another to change an end-to-end length of the sound-post assembly; and wherein the sound-post assembly comprises a static or quasi-static force sensor (e.g., 445*c*, FIG. 4A; 811, FIGS. 8B, 8C).

In some embodiments of the above stringed musical instrument, the static or quasi-static force sensor comprises a piezoresistive material (e.g., 816, FIG. 8C).

In some embodiments of any of the above stringed musical instruments, the piezoresistive material is sandwiched between first and second electrodes (e.g., 812, 814, FIG. 8C) electrically connectable to an electrical circuit (e.g., 820, FIG. 8C).

In some embodiments of any of the above stringed musical instruments, the static or quasi-static force sensor is a static force sensor.

In some embodiments of any of the above stringed musical instruments, the static or quasi-static force sensor is a quasi-static force sensor.

In some embodiments of any of the above stringed musical instruments, the static or quasi-static force sensor is configured to function as a static or quasi-static pressure sensor.

In some embodiments of any of the above stringed musical instruments, the static or quasi-static force sensor is electrically connectable to an external electrical circuit (e.g., 610, 612, FIG. 6).

In some embodiments of any of the above stringed musical instruments, the static or quasi-static force sensor is configured to change one or more of: an electrical resistance thereof; an electrical capacitance thereof; an electrical inductance thereof, in response to a mechanical force applied thereto.

In some embodiments of any of the above stringed musical instruments, the static or quasi-static force sensor is sensitive to a varying force characterized by a frequency smaller than 15 Hz.

In some embodiments of any of the above stringed musical instruments, the static or quasi-static force sensor is sensitive to a varying force characterized by a frequency smaller than 1 Hz.

In some embodiments of any of the above stringed musical instruments, the sound-post assembly further comprises an electrical actuator (e.g., 445*a*, FIG. 4A) connectable to an electrical circuit and configured to change the end-to-end length of the sound post assembly.

In some embodiments of any of the above stringed musical instruments, the electrical actuator comprises a piezoelectric material.

In some embodiments of any of the above stringed musical instruments, the electrical actuator comprises an electro-magnetic motor connected to a lead screw arrangement (e.g., 445*a*, 445*b*, 441*f*, FIG. 4A).

In some embodiments of any of the above stringed musical instruments, the two or more mechanical components are mechanically engaged using a key-and-slot arrangement (541*d*, 541*e*, FIG. 5B) or a pin-and-hole arrangement to restrict relative rotational motion thereof.

In some embodiments of any of the above stringed musical instruments, the sound-post assembly further comprises a mechanism to break a flow of electrical power to the electrical actuator in response to the sound-post assembly reaching or exceeding a pre-determined length (e.g., 901, 904, FIG. 9).

In some embodiments of any of the above stringed musical instruments, the pre-determined length is adjustable.

In some embodiments of any of the above stringed musical instruments, the mechanism comprises a contact rod (e.g., 901, FIG. 9) mounted on a first of the two or more mechanical components (e.g., 441*c*, FIG. 9) and a sleeve (e.g., 904, FIG. 9) mounted on a second of the two or more mechanical components (e.g., 442*c*, FIG. 8).

In some embodiments of any of the above stringed musical instruments, the contact rod comprises elastic end faces (e.g., 902, FIG. 9).

In some embodiments of any of the above stringed musical instruments, the sleeve is longitudinally movable on the second mechanical component.

In some embodiments of any of the above stringed musical instruments, longitudinal movement is accomplished by a thread connecting the sleeve with the second mechanical component.

In some embodiments of any of the above stringed musical instruments, the stringed musical instrument further comprises a wall-mounted electrical connector (e.g., 605, FIG. 6C) connected by electrical wires (e.g., 646, FIG. 6C) to the static or quasi-static force sensor.

In some embodiments of any of the above stringed musical instruments, the wall-mounted electrical connector comprises a static magnet (e.g., 605, FIG. 6C).

In some embodiments of any of the above stringed musical instruments, the wall-mounted electrical connector comprises a static magnet placed on an outer surface of the sound box (e.g., 606, FIG. 6C).

In some embodiments of any of the above stringed musical instruments, the electrical wires are loosely coiled around an elastic mechanical element (e.g., 646, 601, FIG. 6C).

In some embodiments of any of the above stringed musical instruments, the length of the elastic mechanical element is extendable by at least 10%.

In some embodiments of any of the above stringed musical instruments, the length of the elastic mechanical element is extendable by at least 25%.

In some embodiments of any of the above stringed musical instruments, the two or more mechanical components include a swivel end cap (e.g., 442*a*, 442*b*, FIG. 4) including a swivel mechanism formed by a ball-and-socket arrangement; and wherein a center of a spherically shaped cavity of the socket is located below a rim of the swivel end cap by at least 10% of a sphere's radius (e.g., 452, FIG. 4B) corresponding to the spherically shaped cavity.

According to yet another example embodiment disclosed above, e.g., in the summary section and/or in reference to any one or any combination of some or all of FIGS. 1-9, provided is a sound-post assembly (e.g., 440, FIG. 4A) for a stringed musical instrument, the sound-post assembly comprising: two or more mechanical components (e.g., 441, 442, FIG. 4A) movable with respect to one another to change an end-to-end length of the sound-post assembly; and a static or quasi-static force sensor (e.g., 445*c*, FIG. 4A; 811, FIGS. 8B, 8C); and wherein ends of the sound-post assembly are configured to connect upper and lower walls of an inner cavity of a sound box of the stringed musical instrument (e.g., 140*a*, 140*b*, FIG. 1D).

In some embodiments of the above sound post assembly, the static or quasi-static force sensor comprises a piezoresistive material (e.g., 816, FIG. 8C).

In some embodiments of any of the above sound post assemblies, the piezoresistive material is sandwiched between first and second electrodes (e.g., 812, 814, FIG. 8C) electrically connectable to an electrical circuit (e.g., 820, FIG. 8C).

In some embodiments of any of the above sound post assemblies, the static or quasi-static force sensor is a static force sensor.

In some embodiments of any of the above sound post assemblies, the static or quasi-static force sensor is a quasi-static force sensor.

In some embodiments of any of the above sound post assemblies, the static or quasi-static force sensor is configured to function as a static or quasi-static pressure sensor.

In some embodiments of any of the above sound post assemblies, the static or quasi-static force sensor is electrically connectable to an external electrical circuit (e.g., 610, 612, FIG. 6).

In some embodiments of any of the above sound post assemblies, the static or quasi-static force sensor is configured to change one or more of: an electrical resistance thereof; an electrical capacitance thereof; an electrical inductance thereof, in response to a mechanical force applied thereto.

In some embodiments of any of the above sound post assemblies, the static or quasi-static force sensor is sensitive to a varying force characterized by a frequency smaller than 15 Hz.

In some embodiments of any of the above sound post assemblies, the static or quasi-static force sensor is sensitive to a varying force characterized by a frequency smaller than 1 Hz.

In some embodiments of any of the above sound post assemblies, the sound post assembly further comprises an electrical actuator (e.g., 445*a*, FIG. 4A) connectable to an electrical circuit and configured to change the end-to-end length of the sound post assembly.

In some embodiments of any of the above sound post assemblies, the electrical actuator comprises a piezoelectric material.

In some embodiments of any of the above sound post assemblies, the electrical actuator comprises an electromagnetic motor connected to a lead screw arrangement (e.g., 445*a*, 445*b*, 441*f*, FIG. 4A).

In some embodiments of any of the above sound post assemblies, the two or more mechanical components are mechanically engaged using a key-and-slot arrangement (541*d*, 541*e*, FIG. 5B) or a pin-and-hole arrangement to restrict relative rotational motion thereof.

In some embodiments of any of the above sound post assemblies, the sound post assembly further comprises a mechanism to break a flow of electrical power to the electrical actuator in response to the sound-post assembly reaching or exceeding a pre-determined length (e.g., 901, 904, FIG. 9).

In some embodiments of any of the above sound post assemblies, the pre-determined length is adjustable.

In some embodiments of any of the above sound post assemblies, the mechanism comprises a contact rod (e.g., 901, FIG. 9) mounted on a first of the two or more mechanical components (e.g., 441*c*, FIG. 9) and a sleeve (e.g., 904, FIG. 9) mounted on a second of the two or more mechanical components (e.g., 442*c*, FIG. 8).

In some embodiments of any of the above sound post assemblies, the contact rod comprises elastic end faces (e.g., 902, FIG. 9).

In some embodiments of any of the above sound post assemblies, the sleeve is longitudinally movable on the second mechanical component.

In some embodiments of any of the above sound post assemblies, longitudinal movement is accomplished by a thread connecting the sleeve with the second mechanical component.

In some embodiments of any of the above sound post assemblies, the sound post assembly further comprises a wall-mounted electrical connector (e.g., 605, FIG. 6C) connected by electrical wires (e.g., 646, FIG. 6C) to the static or quasi-static force sensor.

In some embodiments of any of the above sound post assemblies, the wall-mounted electrical connector comprises a static magnet (e.g., 605, FIG. 6C).

In some embodiments of any of the above sound post assemblies, the wall-mounted electrical connector comprises a static magnet placed on an outer surface of the sound box (e.g., 606, FIG. 6C).

In some embodiments of any of the above sound post assemblies, the electrical wires are loosely coiled around an elastic mechanical element (e.g., 646, 601, FIG. 6C).

In some embodiments of any of the above sound post assemblies, the length of the elastic mechanical element is extendable by at least 10%.

In some embodiments of any of the above sound post assemblies, the length of the elastic mechanical element is extendable by at least 25%.

In some embodiments of any of the above sound post assemblies, the two or more mechanical components include a swivel end cap (e.g., 442*a*, 442*b*, FIG. 4) including a swivel mechanism formed by a ball-and-socket arrangement; and wherein a center of a spherically shaped cavity of the socket is located below a rim of the swivel end cap by at least 10% of a sphere's radius (e.g., 452, FIG. 4B) corresponding to the spherically shaped cavity.

According to yet another example embodiment disclosed above, e.g., in the summary section and/or in reference to any one or any combination of some or all of FIGS. 1-9, provided is an apparatus, comprising: a sound-post assembly (e.g., 440, FIG. 4A) for a stringed musical instrument; and a control unit (e.g., 611, 612, FIGS. 6A-6C) to electrically interface to one or more functions of the sound-post assembly; wherein the sound-post assembly comprises: two or more mechanical components (e.g., 441, 442, FIG. 4A) movable with respect to one another to change an end-to-end length of the sound-post assembly; and a static or quasi-static force sensor (e.g., 445*c*, FIG. 4A; 811, FIGS. 8B, 8C); wherein ends of the sound-post assembly are configured to connect, directly or indirectly, upper and lower walls of an inner cavity of a sound box of the stringed musical instrument (e.g., 140*a*, 140*b*, FIG. 1D) and wherein the static or quasi-static force sensor is electrically connectable to the control unit.

In some embodiments of the above apparatus, the control unit is configured to read sensor data from the static or quasi-static force sensor.

In some embodiments of any of the above apparatus, the control unit is configured to filter the sensor data using a low-pass cut-off frequency smaller than 15 Hz.

In some embodiments of any of the above apparatus, the control unit is configured to filter the sensor data using a low-pass cut-off frequency smaller than 1 Hz.

In some embodiments of any of the above apparatus, the apparatus further includes an electrical actuator (e.g., 445*a*, FIG. 4A) configured to change the end-to-end length of the sound-post assembly; and wherein the control unit is configured to apply an electrical control signal to the electrical actuator in response to the sensor data.

In some embodiments of any of the above apparatus, the apparatus further includes an electrical actuator configured to change the end-to-end length of the sound-post assembly.

In some embodiments of any of the above apparatus, the control unit is configured to apply an electrical control signal to the electrical actuator.

In some embodiments of any of the above apparatus, the control unit is further configured to read sensor data from the static or quasi-static force sensor; and wherein the electrical control signal depends on said sensor data.

In some embodiments of any of the above apparatus, the control unit is configured to operate the static or quasi-static force sensor and the electrical actuator in a closed-loop setting to maintain a sensor reading within a fixed range.

In some embodiments of any of the above apparatus, the static or quasi-static force sensor comprises a piezoresistive material (e.g., 816, FIG. 8C).

In some embodiments of any of the above apparatus, the piezoresistive material is sandwiched between first and second electrodes (e.g., 812, 814, FIG. 8C) electrically connectable to an electrical circuit (e.g., 820, FIG. 8C).

In some embodiments of any of the above apparatus, the static or quasi-static force sensor is a static force sensor.

In some embodiments of any of the above apparatus, the static or quasi-static force sensor is a quasi-static force sensor.

In some embodiments of any of the above apparatus, the static or quasi-static force sensor is configured to function as a static or quasi-static pressure sensor.

In some embodiments of any of the above apparatus, the static or quasi-static force sensor is electrically connectable to an external electrical circuit (e.g., 610, 612, FIG. 6).

In some embodiments of any of the above apparatus, the static or quasi-static force sensor is configured to change one or more of: an electrical resistance thereof; an electrical capacitance thereof; an electrical inductance thereof, in response to a mechanical force applied thereto.

In some embodiments of any of the above apparatus, the static or quasi-static force sensor is sensitive to a varying force characterized by a frequency smaller than 15 Hz.

In some embodiments of any of the above apparatus, the static or quasi-static force sensor is sensitive to a varying force characterized by a frequency smaller than 1 Hz.

In some embodiments of any of the above apparatus, the apparatus further comprises an electrical actuator (e.g., 445*a*, FIG. 4A) connectable to an electrical circuit and configured to change the end-to-end length of the sound post assembly.

In some embodiments of any of the above apparatus, the electrical actuator comprises a piezoelectric material.

In some embodiments of any of the above apparatus, the electrical actuator comprises an electro-magnetic motor connected to a lead screw arrangement (e.g., 445*a*, 445*b*, 441*f*, FIG. 4A).

In some embodiments of any of the above apparatus, the two or more mechanical components are mechanically engaged using a key-and-slot arrangement (541*d*, 541*e*, FIG. 5B) or a pin-and-hole arrangement to restrict relative rotational motion thereof.

In some embodiments of any of the above apparatus, the apparatus further comprises a mechanism to break a flow of electrical power to the electrical actuator in response to the sound-post assembly reaching or exceeding a pre-determined length (e.g., 901, 904, FIG. 9).

In some embodiments of any of the above apparatus, the pre-determined length is adjustable.

In some embodiments of any of the above apparatus, the mechanism comprises a contact rod (e.g., 901, FIG. 9) mounted on a first of the two or more mechanical components (e.g., 441*c*, FIG. 9) and a sleeve (e.g., 904, FIG. 9) mounted on a second of the two or more mechanical components (e.g., 442*c*, FIG. 8).

In some embodiments of any of the above apparatus, the contact rod comprises elastic end faces (e.g., 902, FIG. 9).

In some embodiments of any of the above apparatus, the sleeve is longitudinally movable on the second mechanical component.

In some embodiments of any of the above apparatus, longitudinal movement is accomplished by a thread connecting the sleeve with the second mechanical component.

In some embodiments of any of the above apparatus, the apparatus further comprises a wall-mounted electrical connector (e.g., 605, FIG. 6C) connected by electrical wires (e.g., 646, FIG. 6C) to the static or quasi-static force sensor.

In some embodiments of any of the above apparatus, the wall-mounted electrical connector comprises a static magnet (e.g., 605, FIG. 6C).

In some embodiments of any of the above apparatus, the wall-mounted electrical connector comprises a static magnet placed on an outer surface of the sound box (e.g., 606, FIG. 6C).

In some embodiments of any of the above apparatus, the electrical wires are loosely coiled around an elastic mechanical element (e.g., 646, 601, FIG. 6C).

In some embodiments of any of the above apparatus, the length of the elastic mechanical element is extendable by at least 10%.

In some embodiments of any of the above apparatus, the length of the elastic mechanical element is extendable by at least 25%.

In some embodiments of any of the above apparatus, the two or more mechanical components include a swivel end cap (e.g., 442*a*, 442*b*, FIG. 4) including a swivel mechanism formed by a ball-and-socket arrangement; and wherein a center of a spherically shaped cavity of the socket is located below a rim of the swivel end cap by at least 10% of a sphere's radius (e.g., 452, FIG. 4B) corresponding to the spherically shaped cavity.

Although referred to as "upper" and "lower" or "top" and "bottom" in exemplary disclosed embodiments, no notion of an absolute orientation is relevant to any specific embodiment of this disclosure, and any assembly exemplary described here may be turned in any way without changing its functionality in the spirit of the disclosure.

Also for purposes of this description, the terms "connect," "connecting," or "connected" refer to any manner known in the art or later developed in which energy and/or force are/is allowed to be transferred between two or more elements, and the interposition of one or more additional elements is contemplated, although not required. The terms "directly connected," etc., specifically imply the absence of such additional elements whereas the terms "indirectly connected" etc., specifically imply the presence of such additional elements. In either case, no implication is made of how the connection is being made, how it is being maintained, and whether or not the connection is permanent. For example, the bridge of a musical instrument may "connect" the strings to the upper wall of the sound box, which means that the bridge is simultaneously in physical contact with the strings and with the upper wall of the sound box to allow transfer of sound vibrations. In this case, the "connection" is maintained by the strings' tension which holds the bridge in place between the strings and the upper wall of the sound box.

As used herein in reference to some embodiments, the phrase "attached to" implies to mean "being in physical contact with", without any implication of how such physical contact is being made, how it is being maintained, and whether or not the resulting attachment is permanent. For example, an attachment can be made by tension forces, by a relatively thin layer of adhesive, or by another suitable binder.

Unless otherwise specified herein, the use of the ordinal adjectives "first," "second," "third," etc., to refer to an object of a plurality of like objects merely indicates that different instances of such like objects are being referred to, and is not intended to imply that the like objects so referred-to have to be in a corresponding order or sequence, either temporally, spatially, in ranking, or in any other manner.

As used herein in reference to some embodiments, the phrase "electrically connect", "electrically connecting", or "electrically connectable" implies to mean "bring in electrical contact", "bringing in electrical contact", or "enabled to bring in electrical contact".

As used herein in reference to some embodiments, the word "connector" implies to mean "electrical connector", denoting a mechanism that establishes electrical contact between one or more electrical conductors embedded in a first part of the connector and the corresponding one or more electrical conductors embedded in a second part (i.e., a counterpart) of the connector. The action of establishing electrical connection between corresponding electrical conductor is referred to as "mating" connector part and connector counterpart. Once mated, connector part and connector counterpart are configured to maintain electrical connections by mechanical arrangements (such as a snap-in arrangement) or by magnetically assisted arrangements.

As used herein in reference to some embodiments, the term "lead screw" implies to mean a male threaded rod or tube, regardless of the type of thread used.

While this disclosure includes references to illustrative embodiments, this specification is not intended to be construed in a limiting sense. Various modifications of the described embodiments, as well as other embodiments within the scope of the disclosure, which are apparent to persons skilled in the art to which the disclosure pertains are deemed to lie within the principle and scope of the disclosure, e.g., as expressed in the following claims.

Some embodiments can be embodied in the form of methods and apparatuses for practicing those methods. Some embodiments can also be embodied in the form of program code recorded in tangible media, such as magnetic recording media, optical recording media, solid state memory, floppy diskettes, CD-ROMs, hard drives, or any other non-transitory machine-readable storage medium, wherein, when the program code is loaded into and executed by a machine, such as a computer, the machine becomes an apparatus for practicing the patented invention(s). Some embodiments can also be embodied in the form of program code, for example, stored in a non-transitory machine-readable storage medium including being loaded into and/or executed by a machine, wherein, when the program code is loaded into and executed by a machine, such as a computer or a processor, the machine becomes an apparatus for practicing the patented invention(s). When implemented on a general-purpose processor, the program code segments combine with the processor to provide a unique device that operates analogously to specific logic circuits.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain the nature of this disclosure may be made by those skilled in the art without departing from the scope of the disclosure, e.g., as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Reference herein to "one embodiment" or "an embodiment" means that a particular feature, structure, or characteristic described in connection with the embodiment can be included in at least one embodiment of the disclosure. The appearances of the phrase "in one embodiment" in various places in the specification are not necessarily all referring to the same embodiment, nor are separate or alternative embodiments necessarily mutually exclusive of other embodiments. The same applies to the term "implementation."

Unless otherwise specified herein, the use of the ordinal adjectives "first," "second," "third," etc., to refer to an object of a plurality of like objects merely indicates that different instances of such like objects are being referred to, and is not intended to imply that the like objects so referred-to have to be in a corresponding order or sequence, either temporally, spatially, in ranking, or in any other manner.

The described embodiments are to be considered in all respects as only illustrative and not restrictive. In particular, the scope of the disclosure is indicated by the appended claims rather than by the description and figures herein. All changes that come within the meaning and range of equivalency of the claims are to be embraced within their scope.

The description and drawings merely illustrate the principles of the disclosure. It will thus be appreciated that those of ordinary skill in the art will be able to devise various arrangements that, although not explicitly described or shown herein, embody the principles of the disclosure and are included within its spirit and scope. Furthermore, all examples recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions. Moreover, all statements herein reciting principles, aspects, and embodiments of the disclosure, as well as specific examples thereof, are intended to encompass equivalents thereof.

The functions of the various elements shown in the figures, including any functional blocks labeled as "processors" and/or "controllers," may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included.

It should be appreciated by those of ordinary skill in the art that any block diagrams herein represent conceptual views of illustrative circuitry embodying the principles of the disclosure.

What is claimed is:

1. A stringed musical instrument, comprising:

a sound box having an inner cavity bounded by an upper wall and a lower wall thereof;

a sound-post assembly having ends thereof connecting directly or indirectly the upper and lower walls in the inner cavity, the sound post assembly including two or more mechanical components movable with respect to one another to change an end-to-end length of the sound-post assembly;

wherein the sound-post assembly comprises a static or quasi-static force sensor; and wherein the static or quasi-static force sensor comprises a piezoresistive material.

2. The stringed musical instrument of claim 1, wherein the piezoresistive material is sandwiched between first and second electrodes electrically connectable to an electrical circuit.

3. The stringed musical instrument of claim 1, wherein the static or quasi-static force sensor is electrically connectable to an external electrical circuit.

4. The stringed musical instrument of claim 1, wherein the static or quasi-static force sensor is configured to change one or more of: an electrical resistance thereof; an electrical capacitance thereof; an electrical inductance thereof, in response to a mechanical force applied thereto.

5. The stringed musical instrument of claim 1, wherein the static or quasi-static force sensor is sensitive to a varying force characterized by a frequency smaller than 15 Hz.

6. The stringed musical instrument of claim 1, wherein the sound-post assembly further comprises an electrical actuator connectable to an electrical circuit and configured to change the end-to-end length of the sound post assembly.

7. The stringed musical instrument of claim 6, wherein the electrical actuator comprises an electro-magnetic motor connected to a lead screw arrangement.

8. The stringed musical instrument of claim 6, wherein the two or more mechanical components are mechanically engaged using a key-and-slot arrangement or a pin-and-hole arrangement to restrict relative rotational motion thereof.

9. The stringed musical instrument of claim 6, wherein the sound-post assembly further comprises a mechanism to break a flow of electrical power to the electrical actuator in response to the sound-post assembly reaching or exceeding a pre-determined length.

10. The stringed musical instrument of claim 1, further comprising a wall-mounted electrical connector connected by electrical wires to the static or quasi-static force sensor.

11. The stringed musical instrument of claim 10, wherein the electrical wires are loosely coiled around an elastic mechanical element.

12. The stringed musical instrument of claim 11, wherein the length of the elastic mechanical element is extendable by at least 10%.

13. A sound-post assembly for a stringed musical instrument, the sound-post assembly comprising:

two or more mechanical components movable with respect to one another to change an end-to-end length of the sound-post assembly; and a static or quasi-static force sensor;

wherein ends of the sound-post assembly are configured to connect upper and lower walls of an inner cavity of a sound box of the stringed musical instrument; and wherein the static or quasi-static force sensor comprises a piezoresistive material.

14. An apparatus, comprising:

a sound-post assembly for a stringed musical instrument; and a control unit to electrically interface to one or more functions of the sound-post assembly;

wherein the sound-post assembly comprises:

two or more mechanical components movable with respect to one another to change an end-to-end length of the sound-post assembly; and a static or quasi-static force sensor;

wherein ends of the sound-post assembly are configured to connect, directly or indirectly, upper and lower walls of an inner cavity of a sound box of the stringed musical instrument;

wherein the static or quasi-static force sensor is electrically connectable to the control unit; and wherein the static or quasi-static force sensor comprises a piezoresistive material.

15. The apparatus of claim 14, wherein the control unit is configured to read sensor data from the static or quasi-static force sensor.

16. The apparatus of claim 15, wherein the control unit is configured to filter the sensor data using a low-pass cut-off frequency smaller than 15 Hz.

17. The apparatus of claim 15, further including an electrical actuator configured to change the end-to-end length of the sound-post assembly; and wherein the control unit is configured to apply an electrical control signal to the electrical actuator in response to the sensor data.

18. A stringed musical instrument, comprising:

a sound box having an inner cavity bounded by an upper wall and a lower wall thereof;

a sound-post assembly having ends thereof connecting directly or indirectly the upper and lower walls in the inner cavity, the sound post assembly including two or more mechanical components movable with respect to one another to change an end-to-end length of the sound-post assembly;

wherein the sound-post assembly comprises a static or quasi-static force sensor;

wherein the sound-post assembly further comprises an electrical actuator connectable to an electrical circuit and configured to change the end-to-end length of the sound post assembly; and wherein the electrical actuator comprises an electro-magnetic motor connected to a lead screw arrangement.

19. A stringed musical instrument, comprising:

a sound box having an inner cavity bounded by an upper wall and a lower wall thereof;

a sound-post assembly having ends thereof connecting directly or indirectly the upper and lower walls in the inner cavity, the sound post assembly including two or more mechanical components movable with respect to one another to change an end-to-end length of the sound-post assembly;

wherein the sound-post assembly comprises a static or quasi-static force sensor;

wherein the sound-post assembly further comprises an electrical actuator connectable to an electrical circuit and configured to change the end-to-end length of the sound post assembly; and wherein the sound-post assembly further comprises a mechanism to break a flow of electrical power to the electrical actuator in response to the sound-post assembly reaching or exceeding a pre-determined length.

20. The stringed musical instrument of claim 19, wherein the pre-determined length is adjustable.

21. The stringed musical instrument of claim 19, wherein the mechanism comprises a contact rod mounted on a first of the two or more mechanical components and a sleeve mounted on a second of the two or more mechanical components.

* * * * *